US011767185B2

(12) United States Patent
Fukushima et al.

(10) Patent No.: US 11,767,185 B2
(45) Date of Patent: Sep. 26, 2023

(54) SHEET CONVEYING DEVICE AND IMAGE FORMING APPARATUS INCORPORATING THE SHEET CONVEYING DEVICE

(71) Applicants: Yasuhide Fukushima, Tokyo (JP); Yu Wakabayashi, Kanagawa (JP); Yuuki Shiga, Kanagawa (JP); Kazuya Yamamoto, Kanagawa (JP); Ryohhei Ohya, Kanagawa (JP)

(72) Inventors: Yasuhide Fukushima, Tokyo (JP); Yu Wakabayashi, Kanagawa (JP); Yuuki Shiga, Kanagawa (JP); Kazuya Yamamoto, Kanagawa (JP); Ryohhei Ohya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 234 days.

(21) Appl. No.: 17/142,371

(22) Filed: Jan. 6, 2021

(65) Prior Publication Data

US 2021/0214176 A1 Jul. 15, 2021

(30) Foreign Application Priority Data

Jan. 15, 2020 (JP) ..... 2020-004410

(51) Int. Cl.
*B65H 5/06* (2006.01)
*B65H 5/36* (2006.01)

(52) U.S. Cl.
CPC ..... *B65H 5/062* (2013.01); *B65H 5/068* (2013.01); *B65H 5/36* (2013.01); *B65H 2403/512* (2013.01); *B65H 2405/324* (2013.01); *B65H 2801/03* (2013.01)

(58) Field of Classification Search
CPC ..... B65H 5/062; B65H 5/068; B65H 5/36; B65H 2403/512; B65H 2404/1451
See application file for complete search history.

(56) References Cited

U.S. PATENT DOCUMENTS 7,455,295 B2 * 11/2008 Marx ..... B65H 5/06 271/274
9,321,603 B1 * 4/2016 Nakamura ..... G03G 15/2064
(Continued)

FOREIGN PATENT DOCUMENTS

JP 9-118449 5/1997
JP 2011-152789 8/2011

*Primary Examiner* — Patrick Cicchino
(74) *Attorney, Agent, or Firm* — Harness, Dickey & Pierce, P.L.C.

(57) ABSTRACT

A sheet conveying device includes a pair of rollers, a biasing member, a guide member, a biasing support, and a biasing force changer. The pair of rollers includes a first roller and a second roller disposed in contact with the first roller. The pair of rollers is configured to hold a sheet between the first roller and the second roller. The biasing member is configured to bias the first roller toward the second roller. The biasing support is configured to support the biasing member and has a guide target member configured to slide along the guide member to move the biasing support. The biasing force changer is configured to change a biasing force of the biasing member along with movement of the biasing support. The guide target member has a portion projecting into a sheet conveyance passage through which the sheet is conveyed by the pair of rollers.

10 Claims, 21 Drawing Sheets

(56) References Cited

U.S. PATENT DOCUMENTS

| | | | | |
|---|---|---|---|---|
| 2006/0239750 | A1* | 10/2006 | Huang | B65H 5/062 400/636.3 |
| 2008/0304866 | A1 | 12/2008 | Takenaka et al. | |
| 2013/0236228 | A1 | 9/2013 | Nagasako et al. | |
| 2014/0133881 | A1 | 5/2014 | Tada et al. | |
| 2014/0232778 | A1* | 8/2014 | Edwards | B65H 7/02 347/16 |
| 2015/0153686 | A1 | 6/2015 | Tanaka et al. | |
| 2015/0253716 | A1 | 9/2015 | Nagasako et al. | |
| 2016/0334747 | A1 | 11/2016 | Wakabayashi et al. | |
| 2017/0185025 | A1 | 6/2017 | Wakabayashi et al. | |
| 2019/0018353 | A1 | 1/2019 | Tomita et al. | |

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2020-004410, filed on Jan. 15, 2020, in the Japan Patent Office, the entire disclosure of which is hereby incorporated by reference herein.

BACKGROUND

Technical Field

Embodiments of the present disclosure relate to a sheet conveying device and an image forming apparatus incorporating the sheet conveying device.

Background Art

Various types of sheet conveying devices are known to include a pair of rollers that holds a sheet to be conveyed, and a biasing member that biases one roller of the pair of rollers toward the other roller of the pair of rollers.

For example, a known sheet conveying device conveys a sheet by a pair of rollers including a drive roller and a pressure roller that presses the drive roller. The known sheet conveying device includes a pressure arm that retains the pressure roller. The pressure arm is rotatably supported about the rotary shaft. A leaf spring (biasing member) is supported by the support shaft al the intermediate position. One end of the leaf spring is in contact with one end of the pressure arm. A biasing member push portion (biasing support portion) is in contact with the opposite end of the leaf spring. By rotating the biasing member push portion about the rotation axis in the rotational direction, the leaf spring is elastically deformed about the support shaft as a fulcrum, so as to press the pressure roller against the drive roller. Further, by rotating the biasing member push portion about the rotation axis in a reverse direction opposite the rotational direction, the elastic deformation of the leaf spring is cancelled to bring the leaf spring to the original shape, and the pressing of the pressure roller against the drive roller is released.

SUMMARY

At least one aspect of this disclosure, a novel sheet conveying device includes a pair of rollers, a biasing member, a guide member, a biasing support, and a biasing force changer. The pair of rollers includes a first roller and a second roller disposed in contact with the first roller. The pair of rollers is configured to hold a sheet between the first roller and the second roller while the sheet is conveyed. The biasing member is configured to bias the first roller toward the second roller. The biasing support is configured to support the biasing member. The biasing support has a guide target member configured to slide along the guide member to move the biasing support. The biasing force changer is configured to change a biasing force of the biasing member along with movement of the biasing support. The guide target member has a portion projecting into a sheet conveyance passage through which the sheet is conveyed by the pair of rollers.

Further, at least one aspect of this disclosure, an image forming apparatus includes the above-described sheet conveying device, and an image bearer configured to form an image on the sheet conveyed by the sheet conveying device.

BRIEF DESCRIPTION OF THE SEVERAL VIEWS OF THE DRAWINGS

Exemplary embodiments of this disclosure will be described in detail based on the following figures, wherein.

Figure 1:
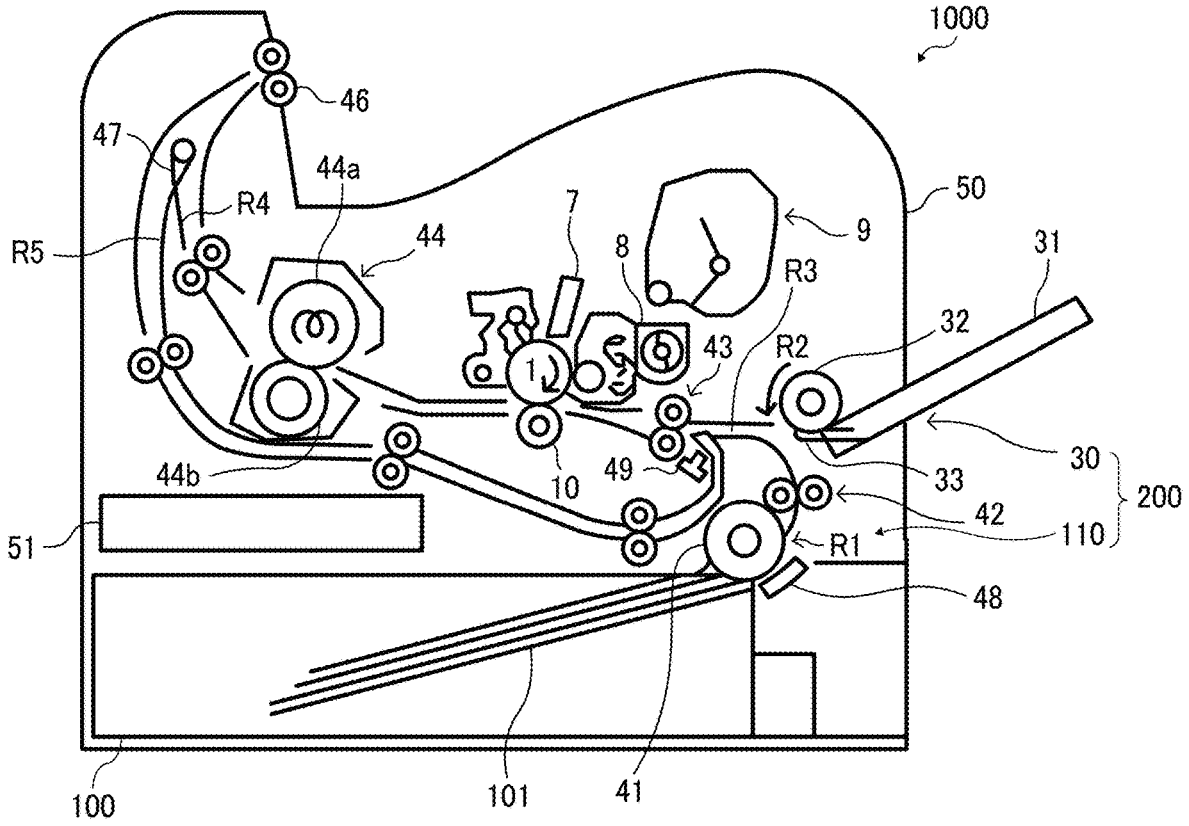
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Now, a description is given of an electrophotographic printer that functions as an electrophotographic image forming apparatus for forming images by electrophotography, according to the present disclosure.

It is to be noted that elements (for example, mechanical parts and components) having the same functions and shapes are denoted by the same reference numerals throughout the specification and redundant descriptions are omitted.

At first, a description is given of a basic configuration of an image forming apparatus 1000 according to an embodiment of this disclosure, with reference to FIG. 1.

FIG. 1 is a schematic diagram illustrating the image forming apparatus 1000 according to an embodiment of this disclosure.

In FIG. 1, the image forming apparatus 1000 according to the present embodiment of this disclosure includes a housing 50, a photoconductor 1, and a sheet tray 100. The photoconductor 1 functions as an image bearer or a latent image bearer. The sheet tray 20 functions as a sheet container that is detachably attachable to the housing 50. The sheet tray 100 contains a plurality of recording sheets S as a sheet bundle that includes a recording sheet S.

As a sheet feed roller 41 is driven to rotate, the recording sheet S is fed from the sheet tray 100. When a plurality of recording sheets S is fed from the sheet tray 100, an uppermost recording sheet S alone is separated from the other recording sheets S in a sheet separation nip region formed between the sheet feed roller 41 and a sheet separation pad 48, and is continuously conveyed downstream in a sheet conveyance direction in which the recording sheet S is conveyed. Then, the recording sheet S (i.e., the uppermost recording sheet S) reaches a regular sheet conveyance passage R1 that functions as a first sheet conveyance passage. Thereafter, the recording sheet S is gripped (held) in a sheet conveyance nip region formed by a pair of relay rollers 42 that functions as a pair of upper conveyance rollers, so that the recording sheet S is conveyed from upstream to downstream in the sheet conveyance direction in the regular sheet conveyance passage R1. Note that the pair of conveyance rollers may be a pair of conveyance bodies, at least one of which is a belt.

The downstream end of the regular sheet conveyance passage R1 communicates with a common sheet conveyance passage R3. A pair of registration rollers 43 is provided in the common sheet conveyance passage R3. A registration sensor 49 that detects the recording sheet S is provided in the common sheet conveyance passage R3, being disposed upstream from the pair of registration rollers 43 in the sheet conveyance direction. When the recording sheet S reaches the pair of registration rollers 43, the recording sheet S is stopped temporality in a stale in which the leading end of the recording sheet S is in contact with the registration nip region of the pair of registration rollers 43 that is stopped. While the leading end of the recording sheet S contacts the pair of registration rollers 43, skew of the recording sheet S is corrected. Note that the registration sensor 49 is also used for an initial operation and a confirmation operation to check whether there is a remaining recording sheet S when cancelling an abnormal stop of the image forming apparatus 1000 (paper jam detection operation).

The pair of registration rollers 43 starts rotating in synchrony with conveyance of the recording sheet S at a timing at which the recording sheet S contacts the surface of the photoconductor 1 to receive a toner image on the surface of the photoconductor 1 in the sheet transfer nip region. Then, the recording sheet S is conveyed toward the sheet transfer nip region. At this time, the pair of relay rollers 42 starts rotating simultaneously with the start of rotation of the pair of relay rollers 42, so as to start conveyance of the recording sheet S that has been temporarily stopped.

The image forming apparatus 1000 includes a bypass sheet feeder 30 in the housing 50. The bypass sheet feeder 30 includes a bypass sheet tray 31, a bypass sheet feed roller 32, a sheet separation pad 33, a bypass bottom plate 34, and a bypass bottom plate cam 35. A detailed description of the bypass sheet feeder 30 is given below. The recording sheet S placed on the bypass sheet tray 31 of the bypass sheet feeder 30 is fed from the bypass sheet tray 31 along with rotation of the bypass sheet feed roller 32 that functions as a sheet feed roller to feed the recording sheet S, to a bypass sheet conveyance passage R2 that functions as a second sheet conveyance passage. The downstream end of the bypass sheet conveyance passage R2 and the downstream end of the regular sheet conveyance passage R1 meet with a common sheet conveyance passage R3. The recording sheet S fed out by the bypass sheet feed roller 32 passes the sheet separation nip region formed by contact of the bypass sheet feed roller 32 and the sheet separation pad 33 in the bypass sheet conveyance passage R2. Then, the recording sheet S is conveyed to the common sheet conveyance passage R3 to be conveyed to the pair of registration rollers 43. Thereafter, similar to the recording sheet S fed from the sheet tray 100, the recording sheet S fed from the bypass sheet tray 31 passes the pair of registration rollers 43 to be conveyed to the transfer nip region.

Figure 2:
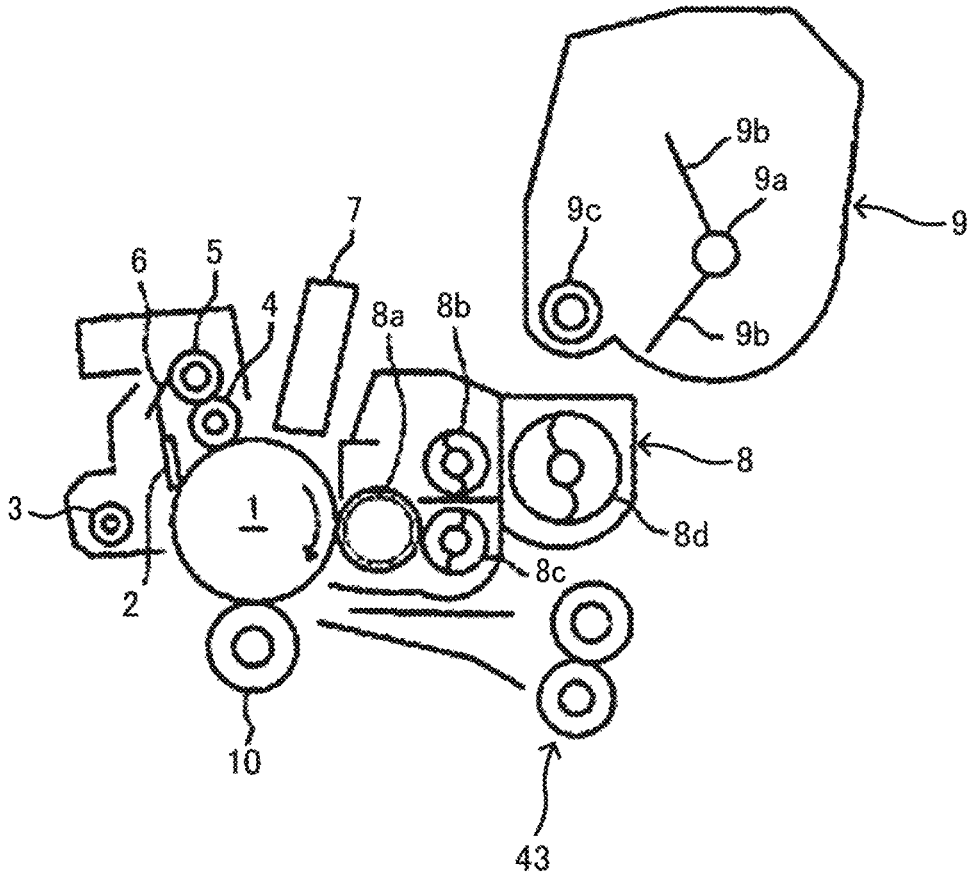
FIG. 2 is an enlarged view illustrating an image forming mechanism including a photoconductor and image forming units disposed around the photoconductor included in the image forming apparatus of FIG. 1.

FIG. 2 is an enlarged view illustrating an image forming mechanism including the photoconductor 1 and the image forming units disposed around the photoconductor 1 included in the image forming apparatus 1000.

To be more specific, a cleaning blade 2, a toner collection screw 3, a charging roller 4, a charging roller cleaning roller 5, a scraper 6, a latent image writing device 7, a developing device 8, and a transfer roller 10 are provided as the image forming units around the drum-shaped photoconductor 1 which is rotated in a clockwise direction in FIG. 2. The photoconductor 1 and the image forming units integrally function as an image forming device. The charging roller 4 includes a conductive rubber roller and forms a charging nip region by rotating while contacting the photoconductor 1. The charging roller 4 is applied with a charging bias that is output from a power source for the charging roller 4. As a result, the surface of the photoconductor 1 is uniformly charged by the charging bias generated between the surface of the photoconductor 1 and the surface of the charging roller 4 in the charging nip region.

The latent image writing device 7 includes an LED (light-emitting diode) array and performs light scanning with LED light over the surface of the photoconductor 1 that has been uniformly charged. As the latent image writing device 7 emits laser light beams onto the uniformly charged surface of the photoconductor 1, the electric potential of the irradiated (exposed) region of the charged surface of the photoconductor 1 attenuate, so that an electrostatic latent image is formed on the surface of the photoconductor 1.

As the photoconductor 1 rotates, the electrostatic latent image passes through a development region that formed between the surface of the photoconductor 1 and the developing device 8 when the photoconductor 1 is brought to face the developing device 8. The developing device 8 includes a developer circulation conveyance portion and a developing portion. The developer circulation conveyance portion includes developer that contains non-magnetic toner and magnetic carriers. The developer circulation conveyance portion includes a first screw 8*b* for conveying the developer to be supplied to a developing roller 8*a*, a second screw 8*c* for conveying the developer in an independent space positioned beneath the first screw 8*b*. The developer circulation conveyance portion further includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c*.

As the first screw 8*b* rotates, the first screw 8*b* conveys the developer from a far side toward a near side in a direction perpendicular to the drawing sheet of FIG. 2. At this time, the first screw 8*b* supplies a portion of the developer to the developing roller 8*a* that is disposed opposite to the first screw 8*b*. The developer having been conveyed by the first screw 8*b* to the vicinity of a far end portion of the first screw 8*b* in the direction perpendicular to the drawing sheet of FIG. 2 is dropped onto the second screw 8*c*.

While receiving used developer from the developing roller 8*a*, the second screw 8*c* conveys the received developer from the far side toward the near side in the direction perpendicular to the drawing sheet of FIG. 2, along with rotation of the second screw 8*c*. The developer conveyed by the second screw 8*c* to the vicinity of a near end portion of the second screw 8*c* in the direction perpendicular to the drawing sheet of FIG. 2 is supplied to the inclined screw 8*d*. Further, along with rotation of the inclined screw 8*d*, the developer is conveyed from the far side toward the near side in the direction perpendicular to the drawing sheet of FIG. 2. Thereafter, the developer is supplied to the first screw 8*b* in the vicinity of the far end portion of the first screw 8*b* in the direction perpendicular to the drawing sheet of FIG. 2.

The developing roller 8*a* includes a developing sleeve and a magnet roller. The developing sleeve is a tubular-shaped rotatable non-magnetic member. The magnet roller is fixed to the developing sleeve in such a way as not to rotate together with the developing sleeve. Part of the developer that is conveyed by the first screw 8*b* is scooped up by the surface of the developing sleeve due to magnetic force generated by the magnet roller. The developer, which is carried onto the surface of the developing sleeve, is conveyed along with rotation of the developing sleeve and passes through an opposing position at which the developing sleeve and a doctor blade are disposed facing each other. According to this structure, the thickness of a layer of the developer on the surface of the developing sleeve is regulated while the developer is rotated together with rotation of the surface of the development sleeve. Thereafter, the developing roller 8*a* moves (rotates) while sliding on the surface of the photoconductor 1 in a development region in which the developing roller 8*a* is brought to face the photoconductor 1.

A development bias having the same polarity as the toner and as a uniformly charged electric potential (a background electric potential) on the surface of the photoconductor 1 is applied to the developing sleeve. The absolute value of this development bias is greater than the absolute value of the electric potential of the latent image and is smaller than the absolute value of the background electric potential on the background surface of the photoconductor 1. Therefore, in the development region, a development potential acts between the electrostatic latent image formed on the photoconductor 1 and the developing sleeve of the developing device 8, so as to electrostatically move the toner from the developing sleeve to the electrostatic latent image on the surface of the photoconductor 1. By contrast, a background potential acts between the background surface of the photoconductor 1 and the development sleeve of the developing device 8, so as to electrostatically move the toner from the photoconductor 1 to the developing sleeve. This action of the background potential causes the toner to selectively adhere to the electrostatic latent image formed on the surface of the photoconductor 1, so that the electrostatic latent image is developed in the development region.

The developer that has passed through the development region enters an opposite region in which the developing sleeve faces the second screw 8*c* as the developing sleeve rotates. In the opposite region, a repulsive magnetic field is formed by two magnetic poles having polarities different from each other out of multiple magnetic poles included in the magnet roller. The developer that has entered the opposite region is separated from the surface of the developing sleeve due to the effect of the repulsive magnetic field and is collected by the second screw 8*c*.

The developer that is conveyed by the inclined screw 8*d* contains the developer that has been collected from the developing roller 8*a*, and this collected developer is contributed to development in the development region, so that the toner concentration is lowered. The developing device 8 includes a toner concentration sensor that detects the toner concentration of the developer to be conveyed by the inclined screw 8*d*. Based on detection results obtained by the toner concentration sensor, a controller 51 outputs a replenishment operation signal for replenishing the toner to the developer that is conveyed by the inclined screw 8*d* accordingly. The controller 51 functions as circuitry that includes semiconductor circuits such as a central processing unit (CPU).

A toner cartridge 9 is disposed above the developing device 8. The toner cartridge 9 contains toner and agitates the toner with agitators 9*b* fixed to a rotary shaft 9*a*. Further, a toner replenishment member 9*c* is driven to rotate according to the replenishment operation signal output from the controller 51. With this operation, an amount of the toner corresponding to an amount of rotation of the toner replenishment member 9*c* is replenished to the inclined screw 8*d* of the developing device 8.

The toner image formed on the surface of the photoconductor 1 as a result of the development by the developing device 8 enters the transfer nip region where the photoconductor 1 and the transfer roller 10 contact each other along with rotation of the photoconductor 1. An electric bias having the opposite polarity to the latent image electric potential of the photoconductor 1 is applied to the transfer roller 10. Accordingly, a transfer bias is formed within the transfer nip region.

As described above, the pair of registration rollers 43 conveys the recording sheet S toward the transfer nip region in synchrony with a timing at which the toner image formed on the photoconductor 1 is overlaid onto the sheet S in the transfer nip region. Due to the transfer bias and the nip pressure, as the recording sheet S is brought to closely contact with the toner image formed on the photoconductor 1 at the transfer nip region, the toner image is transferred onto the recording sheet S.

Residual toner that is not transferred onto the recording sheet S remains on the surface of the photoconductor 1 after having passed through the transfer nip region. After being scraped off from the surface of the photoconductor 1 by the cleaning blade 2 that is in contact with the photoconductor 1, the residual toner is conveyed by the toner collection screw 3, toward a waste toner bottle.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 remain on the charging roller 4 that is in contact with the surface of the photoconductor 1. These foreign materials are shifted to the charging roller cleaning roller 5 that is in contact with the charging roller 4, and then are scraped off from the surface of the charging roller cleaning roller 5 by the scraper 6 that is in contact with the charging roller cleaning roller 5. The foreign materials scraped off from the surface of the charging roller cleaning roller 5 falls onto the toner collection screw 3.

In FIG. 1, the recording sheet 5, which has passed through the transfer nip region formed by the photoconductor 1 and the transfer roller 10 contacting each other, is conveyed to a fixing device 44. The fixing device 44 includes a fixing roller 44*a* and a pressure roller 44*b*. The fixing roller 44*a* includes a heat generating source 44*c* such as a halogen lamp. The pressure roller 44*b* is pressed against the fixing roller 44*a*. The fixing roller 44*a* and the pressure roller 44*b* contact each other to form a fixing nip region. The toner image is fixed to the surface of the recording sheet S that is held in the fixing nip region due to application of heat and pressure. Thereafter, the recording sheet S that has passed through the fixing device 44 passes through a sheet ejection passage R4. Then, the recording sheet S is held in a sheet ejection nip region formed by a pair of sheet ejection rollers 46.

The image forming apparatus 1000 switches printing modes between a single-side printing mode for performing single-side printing and a duplex printing mode for performing duplex printing. In the single-side printing mode, the image forming apparatus 1000 produces an image on one side of the recording sheet S. By contrast, the image forming apparatus 1000 prints respective images on both sides of the recording sheet S in the duplex printing mode. In the single-side printing mode or in the duplex printing mode in which images are formed on both sides of the recording sheet S, the pair of sheet ejection rollers 46 continues rotating in a forward direction and a reverse direction alternately, so that the recording sheet S in the sheet ejection passage R4 is ejected out of the image forming apparatus 1000. After passing through the fixing device 44, the recording sheet S is stacked on a sheet stacker provided on the top face of the housing 50 of the image forming apparatus 1000.

By contrast, in the duplex printing mode when an image is formed on one side of the recording sheet S, the pair of sheet ejection rollers 46 is rotated in the reverse direction at the timing at which the trailing end of the recording sheet S enters the sheet ejection nip region of the pair of sheet ejection rollers 46. At this time, a switching claw 47 disposed near the downstream end of the sheet ejection passage R4 moves to block (close) the sheet ejection passage R4 and open an entrance of a reverse conveyance passage R5 at the same time. As the recording sheet S starts reversing by the reverse rotation of the pair of sheet ejection rollers 46, the recording sheet S is conveyed to the reverse sheet conveyance passage R5. The downstream end of the reverse sheet conveyance passage R5 meets the common sheet conveyance passage R3 on the upstream side from the pair of registration rollers 43 in the sheet conveyance direction.

After being conveyed in the reverse sheet conveyance passage R5, the recording sheet S is conveyed to the pair of registration rollers 43 in the common sheet conveyance passage R3 again. Then, after a toner image has been formed on the other side of the recording sheet S in the transfer nip region, the recording sheet S passes through the fixing device 44, the sheet ejection passage R4, and the pair of sheet ejection rollers 46 and is then ejected to the outside of the housing 50 of the image forming apparatus 1000.

Next, a description is given of the configuration and operations of a sheet conveying device that conveys the recording sheet S.

Figure 3:
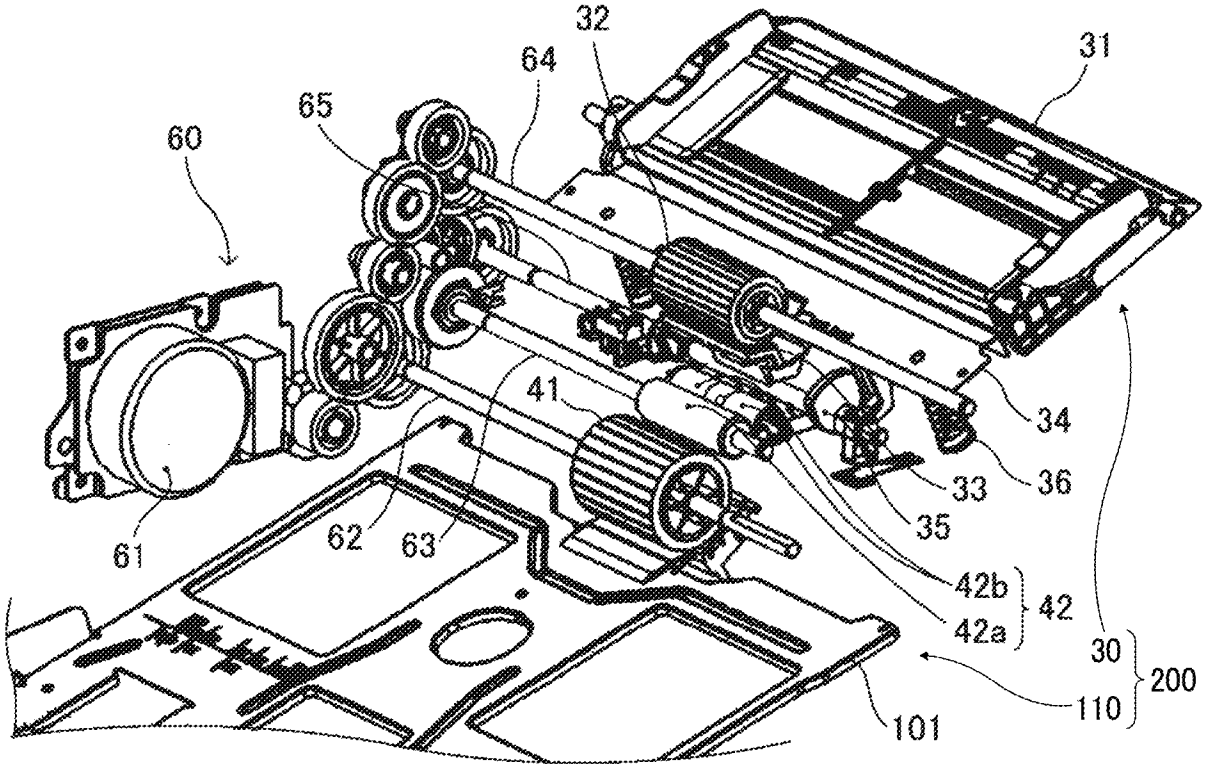
FIG. 3 is a perspective view illustrating the main configuration of a sheet conveying device including a regular sheet feeder to feed a recording sheet from a sheet tray and a bypass sheet feeder to feed a recording sheet from a bypass tray in the image forming apparatus.

FIG. 3 is a perspective view illustrating the main configuration of a sheet conveying device 200 including a regular sheet feeder 110 to feed a recording sheet S from the sheet tray 100 a bypass sheet feeder 30 to feed a recording sheet S from the bypass sheet tray 31 in the image forming apparatus 1000.

Figure 4:
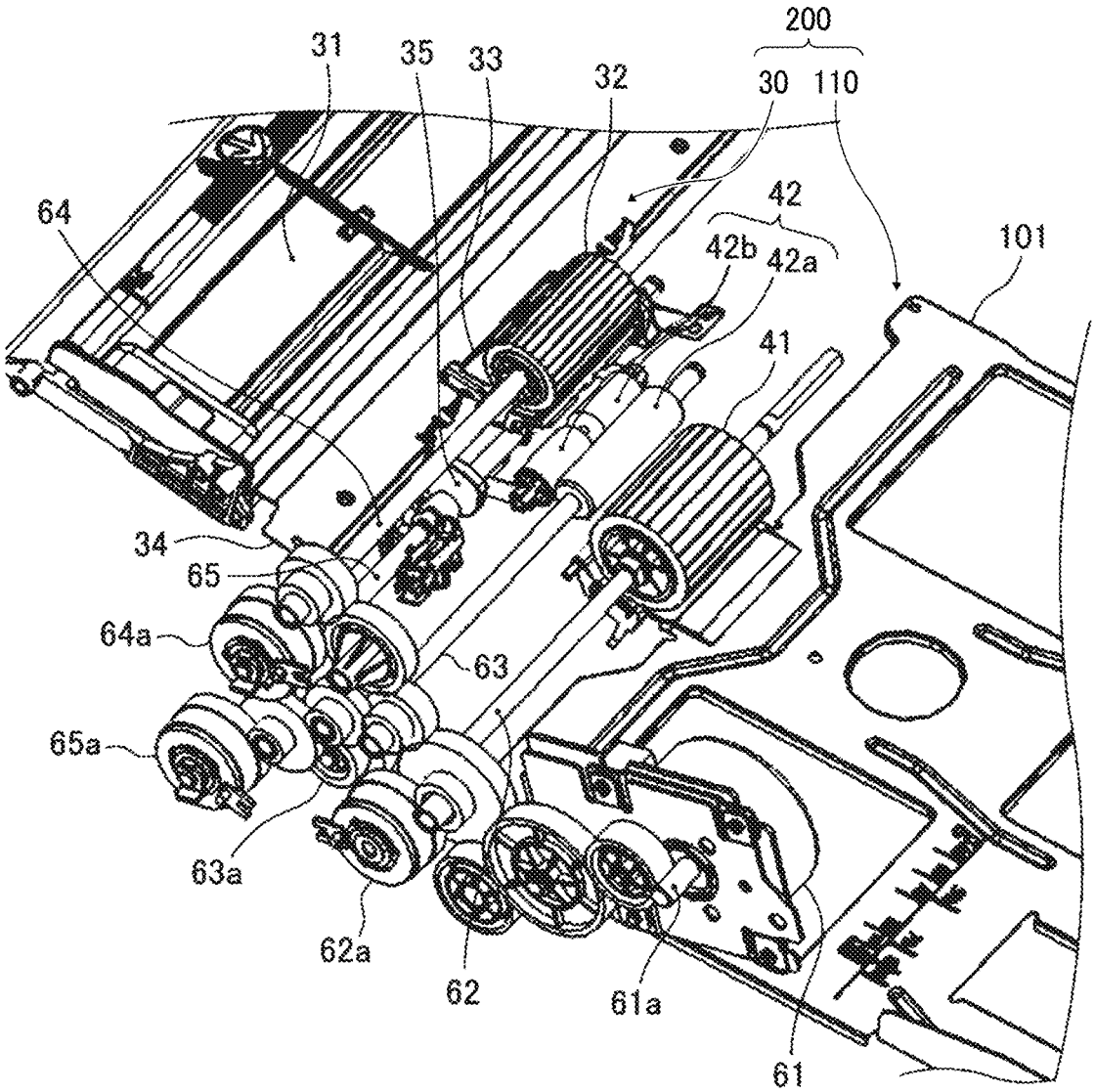
FIG. 4 is a perspective view illustrating a configuration of a drive mechanism in the sheet conveying device for driving the regular sheet feeder and the bypass sheet feeder.

FIG. 4 is a perspective view illustrating a configuration of a drive mechanism in the sheet conveying device 200 for driving the regular sheet feeder 110 and the bypass sheet feeder 30.

As illustrated in FIGS. 3 and 4, the drive mechanism of the regular sheet feeder 110 and the bypass sheet feeder 30 has a configuration in which a single main motor 61 applies driving force to be transmitted (distributed) to the sheet feed roller 41, the pair of relay rollers 42, the bypass sheet feed roller 32, and the bypass bottom plate cam 35. To be more specific, the driving force output from a motor shaft 61*a* of the main motor 61 that functions as a drive source is transmitted, via various idler gears, to a sheet feed roller shaft 62 mounted on the sheet feed roller 41, a relay roller shaft 63 mounted on the pair of relay rollers 42, a bypass sheet feed roller shaft 64 mounted on the bypass sheet feed roller 32, and a bypass bottom plate cam shaft 65 mounted on the bypass bottom plate cam 35. In other words, the sheet feed roller shaft 62, the relay roller shaft 63, the bypass sheet feed roller shaft 64, and the bypass bottom plate cam shaft 65 receive the driving force from the motor shaft 61*a* of the main motor 61.

The sheet feed roller shaft 62, the relay roller shaft 63, the bypass sheet feed roller shaft 64, and the bypass bottom plate cam shaft 65 includes respective clutches 62*a*, 63*a*, 64*a*, and 65*a* to turn on and off transmission of the driving force. When each clutch is turned on, the driving force is transmitted to rotate the sheet feed roller shaft 62, the relay roller shaft 63, the bypass sheet feed roller shaft 64, and the bypass bottom plate cam shaft 65. By contrast, when each clutch is turned off, transmission of the driving force is interrupted, and therefore the sheet feed roller shaft 62, the relay roller shaft 63, the bypass sheet feed roller shaft 64, and the bypass bottom plate cam shaft 65 do not rotate. Note that the driving force of the main motor 61 is also transmitted to the pair of registration rollers 43 via a registration clutch for the pair of registration rollers 43. In the present embodiment, the controller 51 controls turning on and off of each clutch (i.e., the clutches 62*a*, 63*a*, 64*a*, and 65*a*) using the driving force of the main motor 61, so as to perform conveyance of the recording sheet S. In other words, the controller 51 controls conveyance of the recording sheet S.

Figure 5:
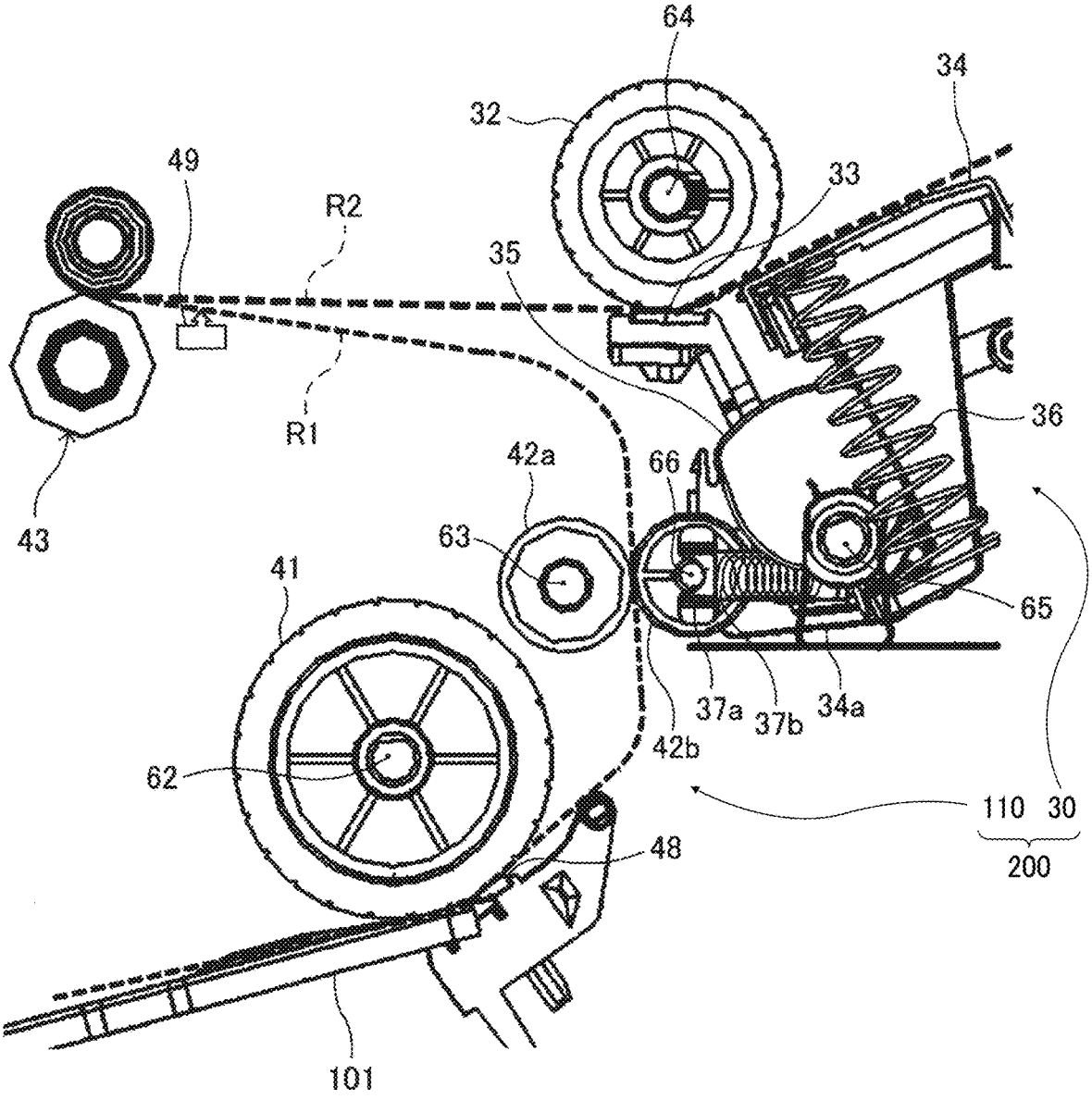
FIG. 5 is a diagram illustrating a sheet conveyance passage in the regular sheet feeder and a sheet conveyance passage in the bypass sheet feeder.

FIG. 5 is a diagram illustrating a sheet conveyance passage in the regular sheet feeder 110 and a sheet conveyance passage in the bypass sheet feeder 30.

Figure 6:
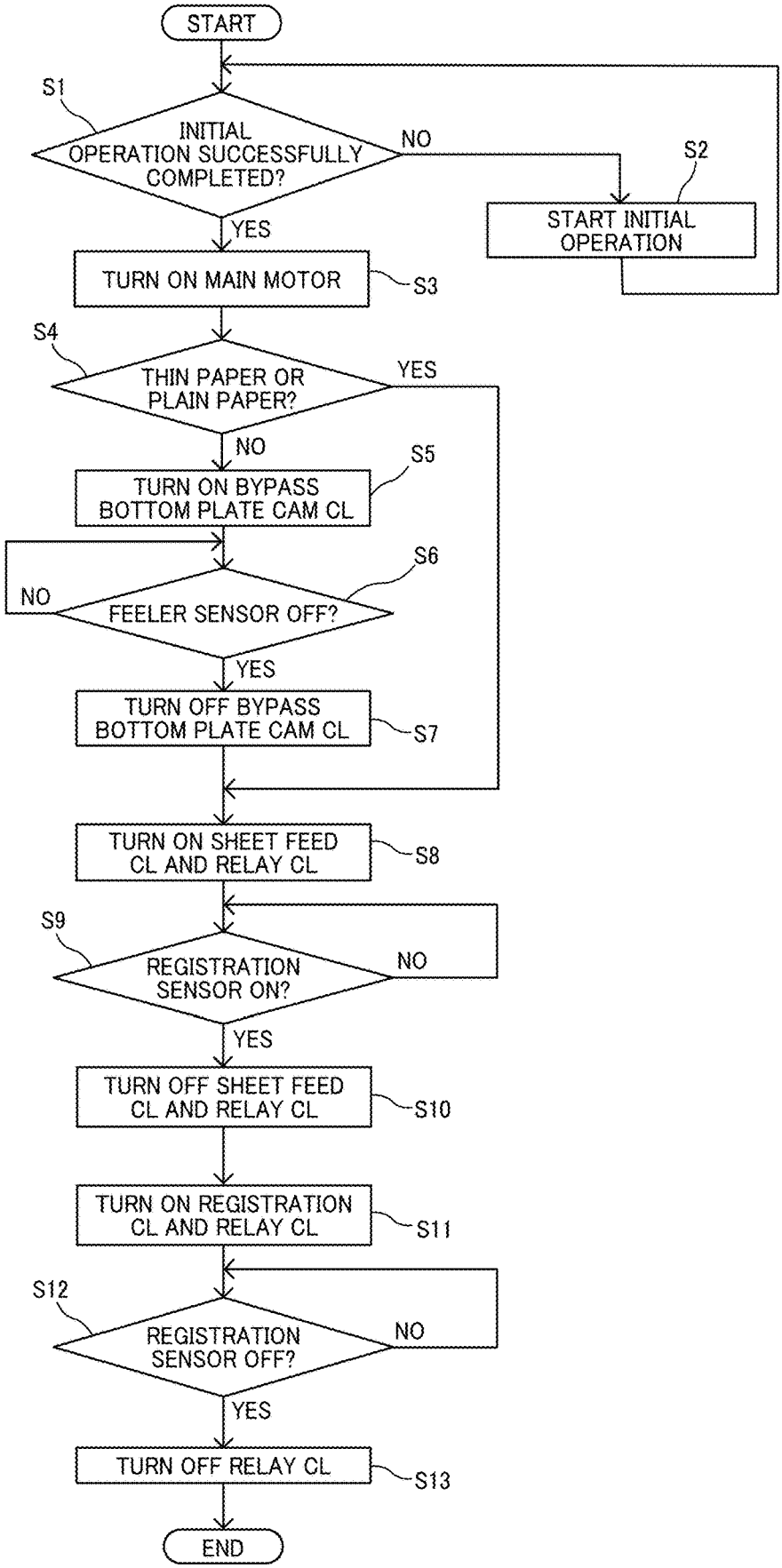
FIG. 6 is a flowchart of a control operation of sheet conveyance from the regular sheet feeder.

FIG. 6 is a flowchart of a control operation of sheet conveyance from the regular sheet feeder 110.

First, a description is given of conveyance of the recording sheet S from the regular sheet feeder 110, with reference to the flowchart of FIG. 6.

Figure 10:
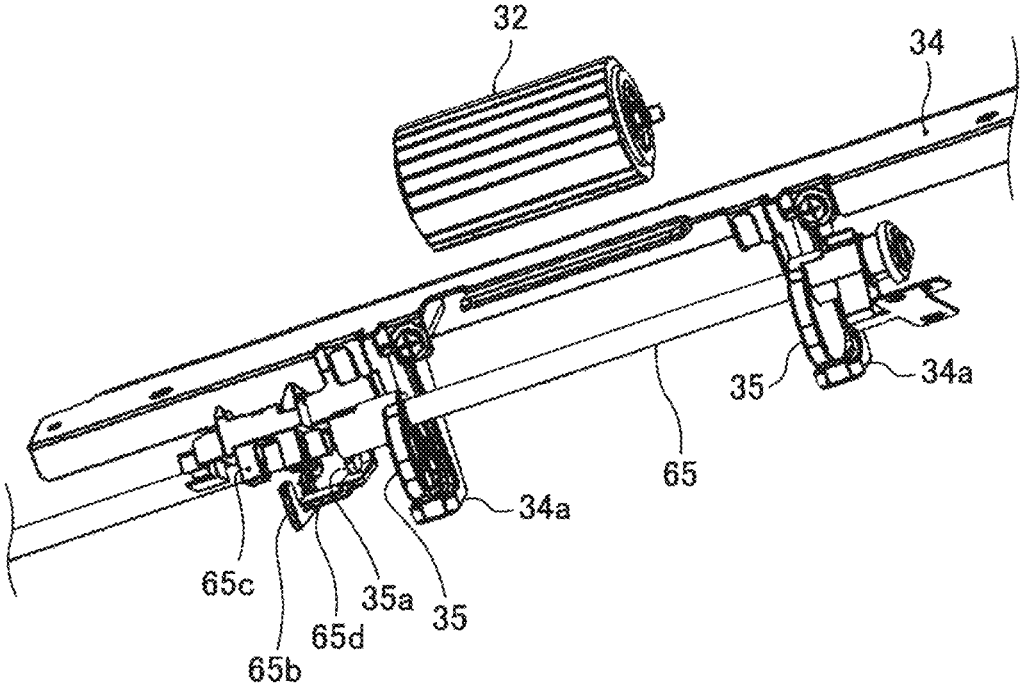
FIG. 10 is a perspective view illustrating a state in which a bypass bottom plate is separated from the bypass sheet feed roller.

The regular sheet feeder 110 includes a regular sheet feeder bottom plate 101 that is biased upward toward the sheet feed roller 41. Since the regular sheet feeder bottom plate 101 is biased as described above, the sheet feed roller 41 is in contact with an uppermost recording sheet S of the plurality of recording sheets S loaded in a form of a sheet bundle on the regular sheet feeder bottom plate 101. When starting conveyance of the recording sheet S from the regular sheet feeder 110, the controller 51 confirms whether the initial operation is completed (step S1). When the initial operation is not completed (NO in step S1), the controller 51 starts the initial operation (step S2). Here, the "initial operation" indicates an operation to lower the bypass bottom plate 34 to the lowest position (see FIGS. 10, 14A, and 15A). Then, after the initial operation has been finished, the nip pressure of the pair of relay rollers 42 is set to the lower state.

When the initial operation is completed (YES in step S1), the controller 51 turns on the main motor 61 (step S3), and then determines whether the recording sheet S to be fed is a thin paper or a plain paper (step S4). In the present embodiment, a user operates the operation panel of the image forming apparatus 1000, so that one type of sheet among various types of sheets printable in the image forming apparatus 1000, for example, plain paper (having a relatively low strength), thin paper (having a relatively low strength), and thick paper (having a relatively high strength) is selected as the recording sheet S contained in the sheet tray 100. The selection result is stored in a memory of the controller 51. In the process step S4 in the present embodiment, the controller 51 determines whether the recording sheet S to be fed is a thin paper or a plain paper based on the selection result stored in the memory.

Note that a method of determination of whether the sheet is a thin paper or a plain paper is not limited to this method of determination. For example, a sheet thickness detection sensor may detect the thickness of the recording sheet S contained in the sheet tray 100 or the thickness of the recording sheet S fed from the sheet tray 100 and the controller 51 may determine the type of the sheet based on the detection result.

Further, in the present embodiment, the type of the recording sheet S that is a determination target is determined based on the difference in the thickness of the recording sheet S. However, the type of the recording sheet S may be determined based on the difference in the characteristics that affect the difference in the strength of the recording sheet S or in the sheet conveyance load of the recording sheet S, for example, the difference in the material or size of the recording sheet S.

In the present embodiment, when the controller 51 has determined the recording sheet S is a thin paper or a plain paper (YES in step S4), since the nip pressure of the pair of relay rollers 42 has been lowered due to the above-described initial operation, the controller 51 maintains the low state of the nip pressure.

By contrast, when the controller 51 has determined the recording sheet S is not a thin paper or a plain paper, in other words, when the controller 51 has determined the recording sheet S is a thick paper (NO in step S4), the controller 51 performs a process operation to increase the nip pressure of the pair of relay rollers 42. To be more specific, in the initial operation, since the nip pressure of the pair of relay rollers 42 has been lowered, the controller 51 turns on the bypass sheet bottom plate cam clutch 65*a* (step S5) to cause the bypass bottom plate cam shall 65 to rotate in the clockwise direction in FIG. 5. Then, the controller 51 determines whether the feeler sensor 65*c* is turned off (step S6). When the feeler sensor 65*c* is not turned off (NO in step S6), the controller 51 repeats the process until the feeler sensor 65*c* is turned off. When the feeler sensor 65*c* is turned off (YES in S6) (see FIGS. 8, 14B, and 15B), the controller 51 turns off the bypass sheet bottom plate cam clutch 65*a* (step S7) to cause the bypass bottom plate cam shaft 65 to stop rotating.

Further, a relay driven roller 42*b* that is the other of the pair of relay rollers 42 has a roller shaft 66 that is received by a bearing 37*a*. As illustrated in FIG. 5, the relay driven roller 42*b* is biased by a biasing force of a pressure spring 37*b* that is a compression spring at the bearing 37*a*, so that the relay driven roller 42*b* is in contact with the relay drive roller 42*a* due to the biasing force of the pressure spring 37*b*. In the state in which the bypass bottom plate cam shaft 65 is stopped at the above-described rotational position, the amount of contraction of the pressure spring 37*b* increases, and therefore the nip pressure of the pair of relay rollers 42 is adjusted to the high nip pressure state. Note that a detailed description of the configuration to change (adjust) the nip pressure of the pair of relay rollers 42 is deferred.

Thereafter, the controller 51 turns on the regular sheet feed clutch 62*a* and the relay clutch 63*a* (step S8). Consequently, as the sheet feed roller 41 rotates, the uppermost recording sheet S in the sheet tray 100 is fed toward the sheet separation pad 48. At this time, even if the second and subsequent recording sheets S are fed together with the uppermost recording sheet S, the conveyance of the second and subsequent recording sheets S is hindered by the frictional force with the sheet separation pad 48, and the uppermost recording sheet S alone passes the sheet separation pad 48. Note that, while the recording sheet S is fed (conveyed) from the regular sheet feeder 110, no recording sheet S is conveyed from the bypass sheet feeder 30. Therefore, the bypass sheet feed clutch 64*a* and the bypass sheet bottom plate cam clutch 65*a* are remained in an OFF state.

Thereafter, the recording sheet S that is fed from the sheet tray 100 is conveyed along the regular sheet conveyance passage R1 in FIG. 5. At this time, a relay drive roller 42*a* that is one of the pair of relay rollers 42 is driven to rotate by the driving force of the main motor 61. Further, the relay driven roller 42*b* that is the other of the pair of relay rollers 42 is biased by the biasing force of the pressure spring 37*b* at the bearing 37*a* that receives a roller shaft 66 of the pair of relay rollers 42. To be more specific, the relay driven roller 42*b* is biased by the relatively low biasing force of the pressure spring 37*b* at the bearing 37*a* when the recording sheet S is a thin paper or a plain paper or by the relatively high biasing force of the pressure spring 37*b* at the bearing 37*a* when the recording sheet S is a thick paper. The relay driven roller 42*b* is in contact with the relay drive roller 42*a* due to the biasing force of the pressure spring 37*b*. Accordingly, the relay driven roller 42*b* is rotated along with rotation of the relay drive roller 42*a*. The recording sheet S conveyed through the regular sheet conveyance passage R1 is conveyed in a state in which the recording sheet S is sandwiched (held) in a relay nip region by the relay drive roller 42*a* and the relay driven roller 42*b*.

When the leading end of the recording sheet S reaches the registration sensor 49, the controller 51 determines whether the registration sensor 49 has turned on (step S9). When the registration sensor 49 has turned on (YES in step S9), the controller 51 turns off the regular sheet feed clutch 62*a* and the relay clutch 63*a* after a given time has elapsed (before the leading end of the recording sheet S reaches the pair of registration rollers 43) (step S10), The given time is, for example, 100 ms from the turning on of the registration sensor 49. After step S6, conveyance of the recording sheet S is temporarily stopped. Accordingly, the leading end of the recording sheet S contacts the registration nip region of the pair of registration rollers 43 that has been stopped, so that skew of the recording sheet S is corrected.

Then, the controller 51 turns on the relay clutch 63*a* and the registration clutch at a timing at which the recording sheet S is overlaid on the toner image formed on the surface of the photoconductor 1 in the transfer nip region (step S11). The timing is, for example, 200 ms after the controller 51 has turned off the regular sheet feed clutch 62*a* and the relay clutch 63*a*. Accordingly, the controller 51 starts the pair of registration rollers 43 and the pair of relay rollers 42 to rotate to convey the recording sheet S toward the transfer nip region. At this time, since the regular sheet feed clutch 62*a* remains off, the sheet feed roller 41 is not rotated. Even in a state in which the trailing end of the recording sheet S is sandwiched (held) between the sheet feed roller 41 and the sheet separation pad 48, the sheet feed roller 41 is rotated along with movement of the recording sheet S conveyed by the conveyance force of the pair of registration rollers 43 and the conveyance force of the pair of relay rollers 42. Therefore, conveyance of the recording sheet S is not hindered. Then, the controller 51 determines whether the registration sensor 49 is turned off (step S12). When the trailing end of the recording sheet S reaches the registration sensor 49 and the registration sensor 49 is turned off (YES in step S12), the controller 51 turns off the relay clutch 63*a* (step S13) to stop rotation of the pair of relay rollers 42.

Figure 7:
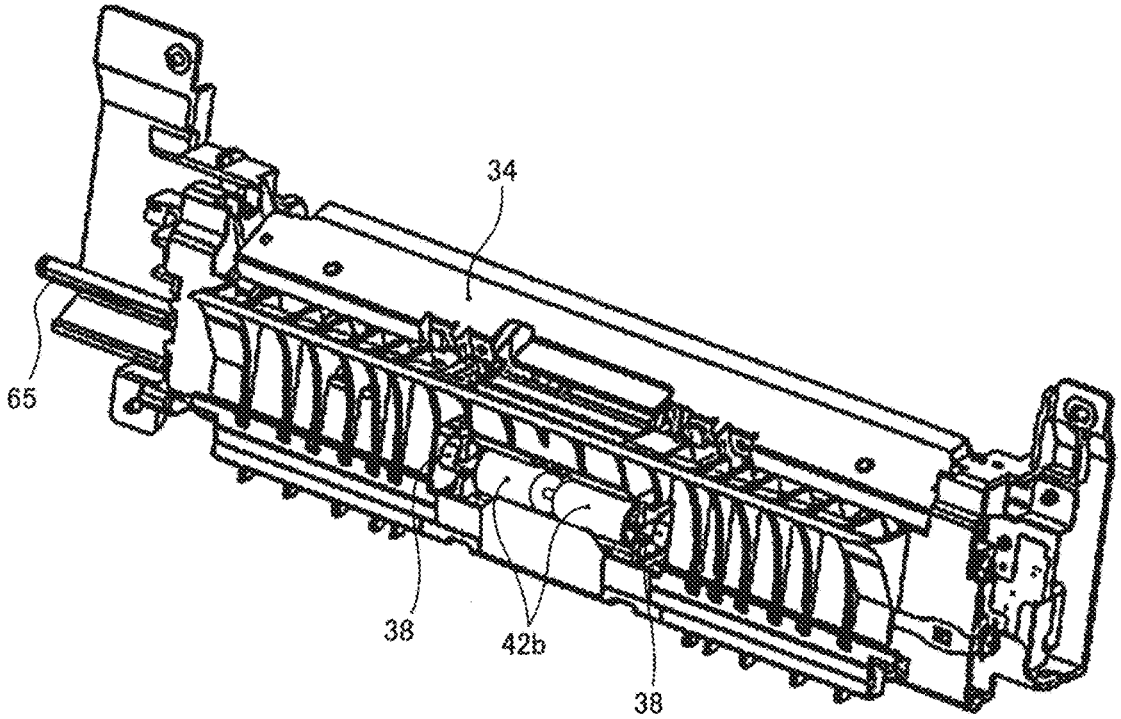
FIG. 7 is an external perspective view illustrating a state in which the bypass tray is removed from the bypass sheet feeder.
Figure 8:
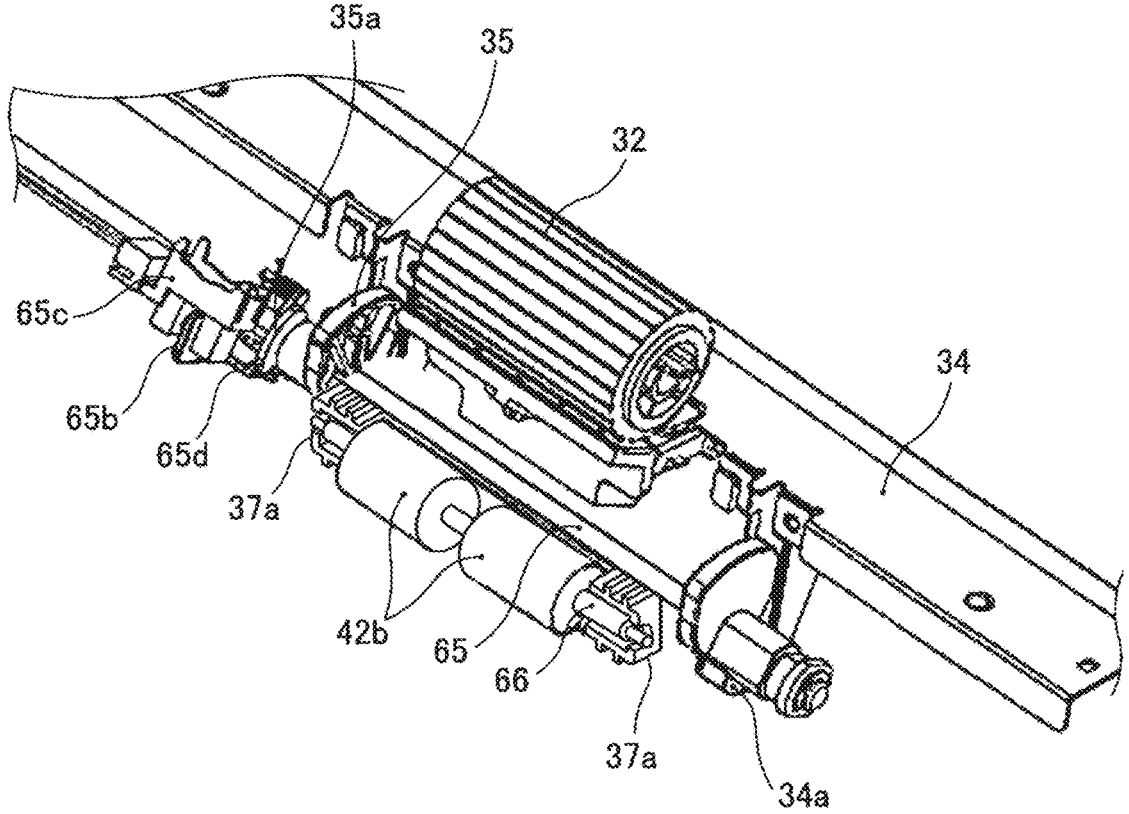
FIG. 8 is a perspective view illustrating a main part of the bypass sheet feeder.
Figure 9:
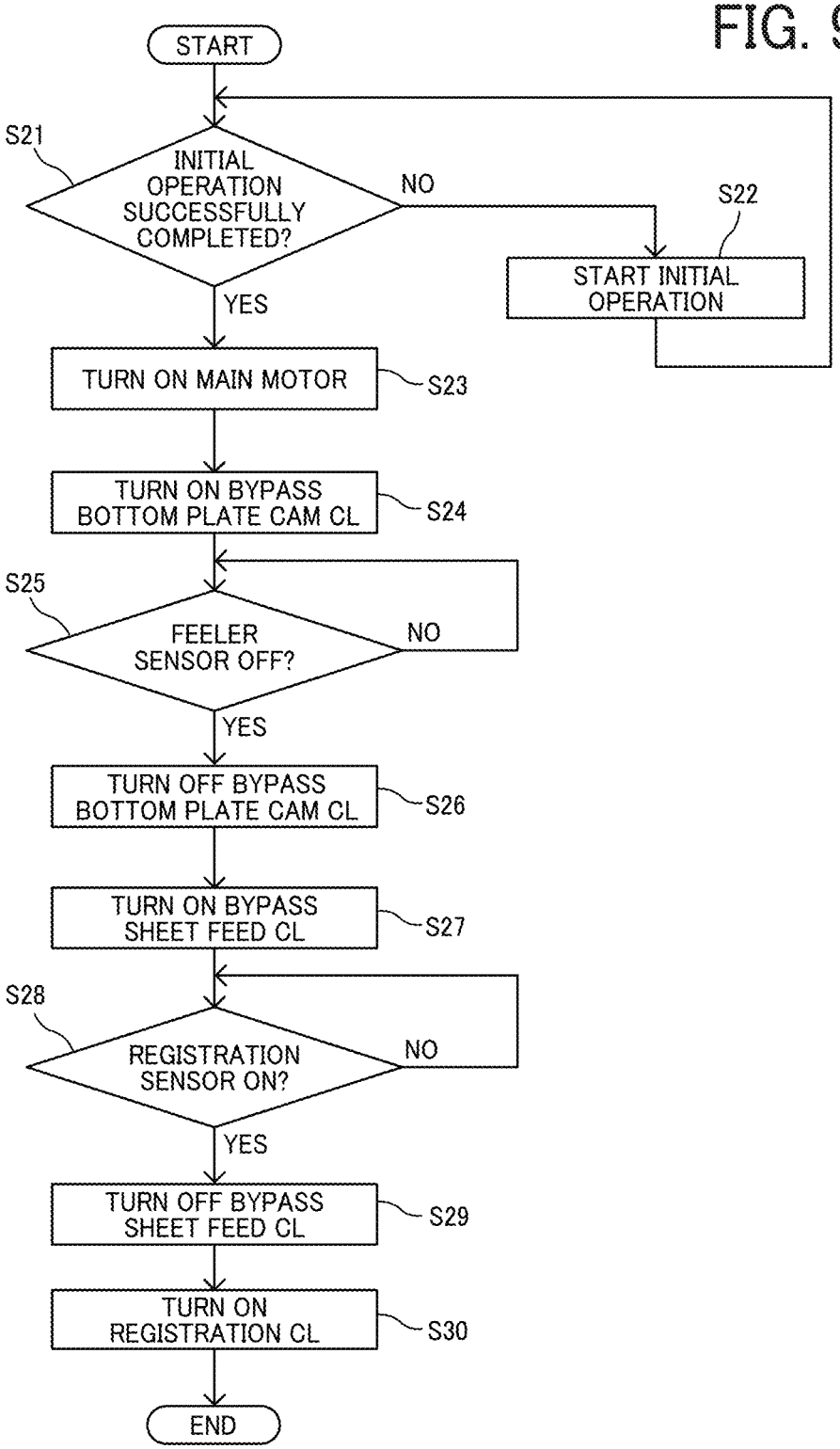
FIG. 9 is a flowchart of a control operation of sheet conveyance from the bypass sheet feeder.

Next, a description is given of conveyance of the recording sheet S from the bypass sheet feeder 30, with reference to FIGS. 7 to 9.

FIG. 7 is an external perspective view illustrating a state in which the bypass sheet tray 31 is removed from the bypass sheet feeder 30.

FIG. 8 is a perspective view illustrating the main configuration of the bypass sheet feeder 30.

FIG. 9 is a flowchart of a control operation of sheet conveyance from the bypass sheet feeder 30.

The bypass bottom plate 34 is biased by a bottom plate spring 36 upward toward the bypass sheet feed roller 32 that is disposed facing the bypass bottom plate 34. Further, as illustrated in FIG. 8, a bottom plate guide 34*a* is provided on the bypass bottom plate 34, at a portion facing the bypass bottom plate cam 35. As the bypass bottom plate cam shaft 65 rotates, the bypass bottom plate cam 35 contacts the bottom plate guide 34*a* to press down the bottom plate guide 34*a* (see FIG. 10). By so doing, the bypass bottom plate 34 lowers against the biasing force of the bottom plate spring 36 to separate from the bypass sheet feed roller 32.

When starting conveyance of the recording sheet S from the bypass sheet feeder 30, the controller 51 confirms whether the initial operation is completed (step S21), When the initial operation is not completed (NO in step S21), the controller 51 starts the initial operation (step S22). When the initial operation is completed (YES in step S21), the controller 51 turns on the main motor 61 (step S23), and then turns on the bypass sheet bottom plate cam clutch 65*a* (step S24). As the bypass bottom plate cam shaft 65 rotates, the bypass bottom plate cam 35 changes (transits) states from a state in which the bypass bottom plate cam 35 is in contact with the bottom plate guide 34*a* (in other words, a state in which the bypass bottom plate 34 is separated from the bypass sheet feed roller 32) (see FIG. 10) to a state in which the bypass bottom plate cam 35 is not in contact with the bottom plate guide 34*a* (see FIGS. 5 and 8).

To be more specific, the bypass sheet feeder 30 includes a projecting plate 35*a* that is integrally formed with the bypass bottom plate cam 35, and a press-down lever 65*d* that presses down a cam detection feeler 65*b*. As the bypass bottom plate cam shaft 65 rotates, the projecting plate 35*a* rotates from a position at which the projecting plate 35*a* contacts the press-down lever 65*d* to press down the cam detection feeler 65*h* (see FIG. 10) to a position at which the projecting plate 35*a* is separated from the press-down lever 65*d*. Accordingly, the cam detection feeler 65*b* is lifted due to a given biasing force to change (transit) to a state in which the cam detection feeler 65*b* blocks the feeler sensor 65*c* (see FIG. 8). Note that the state in which the cam detection feeler 65*b* blocks the feeler sensor 65*c* (see FIG. 8) indicates the state in which the feeler sensor 65*c* is turned on, and the state in which the cam detection feeler 65*b* does not block the feeler sensor 65*c* (see FIG. 10) indicates the state in which the feeler sensor 65*c* is turned off.

The controller 51 determines whether the feeler sensor 65*c* is turned off (step S25). When the feeler sensor 65*c* is turned off (YES in step S25), the controller 51 turns off the bypass sheet bottom plate cam clutch 65*a* (step S26). Accordingly, the bypass bottom plate cam shaft 65 stops rotating in the state in which the bypass bottom plate cam 35 is not in contact with the bottom plate guide 34*a*, in other words, is separated from the bottom plate guide 34*a*. Therefore, the bypass bottom plate 34 is biased by the biasing force of the bottom plate spring 36 toward the bypass sheet feed roller 32. As a result, the bypass sheet feed roller 32 is in contact with the uppermost recording sheet S of the plurality of recording sheets S loaded in a form of a sheet bundle on the bypass sheet tray 31 and the bypass bottom plate 34. The bypass sheet tray 31 and the bypass bottom plate 34 are coupled to each other, each of which functioning as a sheet loader.

Subsequently, the controller 51 turns on the bypass sheet feed clutch 64*a* (step S27). Consequently, as the bypass sheet teed roller 32 rotates, the uppermost recording sheet S on the bypass bottom plate 34 is fed toward the sheet separation pad 33. At this time, even if the second and subsequent recording sheets S are fed together with the uppermost recording sheet S, the conveyance of the second and subsequent recording sheets S is hindered by the frictional force with the sheet separation pad 33, and the uppermost recording sheet S alone passes the sheet separation pad 33.

Note that, while the recording sheet S is fed (conveyed) from the bypass sheet feeder 30, no recording sheet S is conveyed from the regular sheet feeder 110. Therefore, the regular sheet feed clutch 62*a* and the relay clutch 63*a* are remained in an OFF state.

Thereafter, the recording sheet S that is fed from the bypass sheet tray 31 is conveyed along the bypass sheet conveyance passage R2 in FIG. 5. When the leading end of the recording sheet S reaches the registration sensor 49, the controller 51 determines whether the registration sensor 49 has turned on (step S28). When the registration sensor 49 has turned on (YES in step S28), the controller 51 turns off the bypass sheet feed clutch 64*a* after a given time has elapsed (before the leading end of the recording sheet S reaches the pair of registration rollers 43) (step S29). After step S29, conveyance of the recording sheet S is temporarily stopped. Accordingly, the leading end of the recording sheet S contacts the registration nip region of the pair of registration rollers 43 that has been stopped, so that skew of the recording sheet S is corrected.

Then, the controller 51 turns on the registration clutch at a timing at which the recording sheet S is overlaid on the toner image formed on the surface of the photoconductor 1 in the transfer nip region (step S30). Accordingly, the controller 51 starts the pair of registration rollers 43 to rotate to convey the recording sheet S toward the transfer nip region.

As illustrated in FIG. 8, the bypass sheet feeder 30 in the present embodiment has a unit structure in which the relay driven roller 42*b*, which is one of the pair of relay rollers 42, is supported integrally with a bypass sheet feeding mechanism. This unit structure including the relay driven roller 42*b* and the bypass sheet feeding mechanism is screwed and fixed to the housing 50 of the image forming apparatus 1000. On the other hand, the relay drive roller 42*a* that is the other roller of the pair of relay rollers 42 is supported by the housing 50 of the image forming apparatus 1000. Therefore, in the present embodiment, the relay driven roller 42*b* that is provided in the unit and the relay drive roller 42*a* that is provided in the housing 50 of the image forming apparatus 1000 are configured so as not to be separated from each other.

A further detailed description is given of the configuration of the relay drive roller 42*a* and the relay driven roller 42*b* of the pair of relay rollers 42.

Figure 11A:
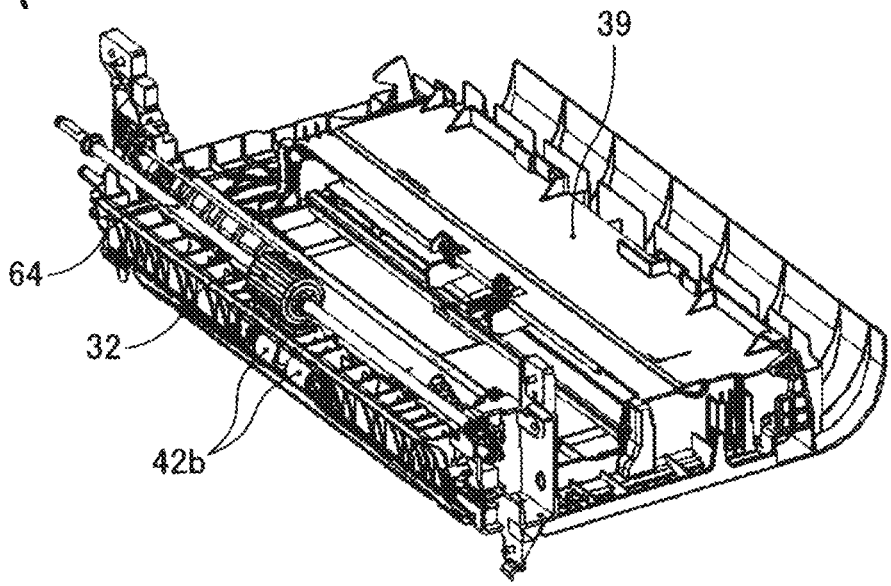
FIGS. 11A and 11B are perspective views each illustrating a door to which the bypass tray is attached is open from the housing of the image forming apparatus.
Figure 11B:
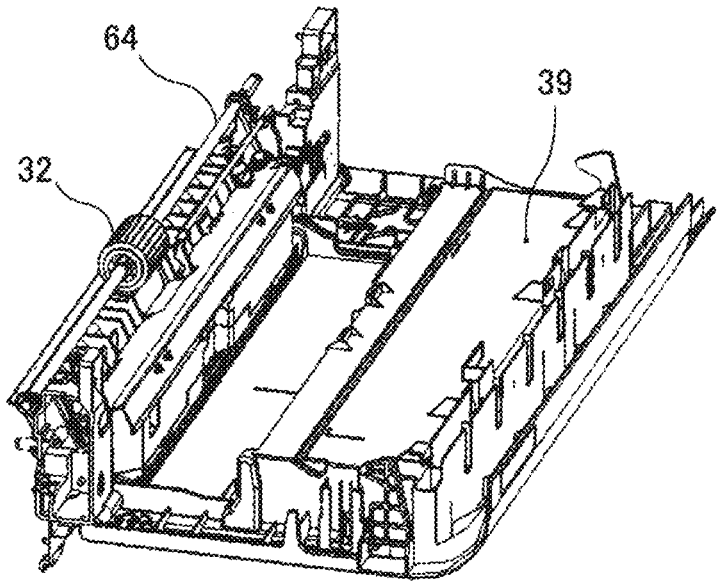

FIGS. 11A and 11B are perspective views each illustrating a door 39 to which the bypass sheet tray 31 is attached and the door 39 is open from the housing of the image forming apparatus 1000.

Figure 12A:
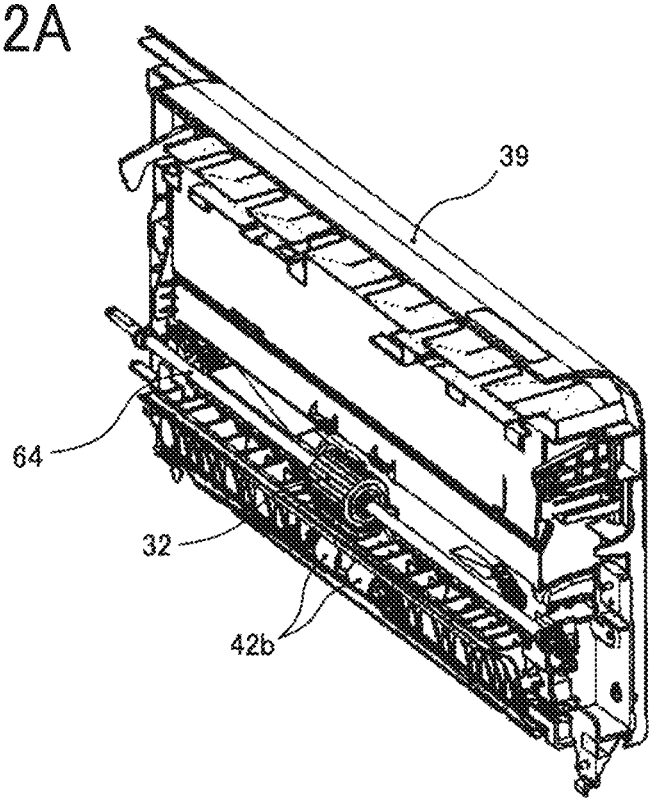
FIGS. 12A and 12B are perspective views each illustrating the door to which the bypass tray is attached is closed to the housing of the image forming apparatus.
Figure 12B:
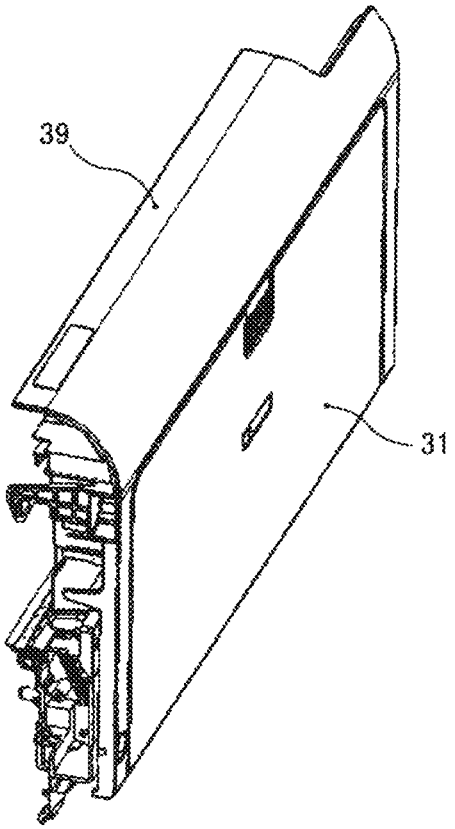

FIGS. 12A and 12B are perspective views each illustrating the door 39 to which the bypass sheet tray 31 is attached and the door 39 is closed to the housing of the image forming apparatus 1000.

Figure 13A:
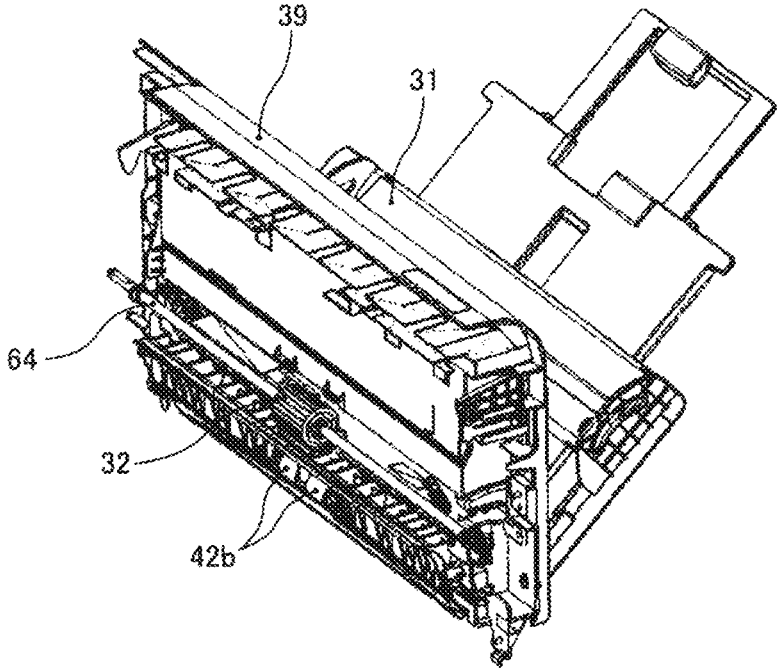
FIGS. 13A and 13B are perspective views each illustrating that the bypass tray is open in a state in which the door is closed to the housing of the image forming apparatus.
Figure 13B:
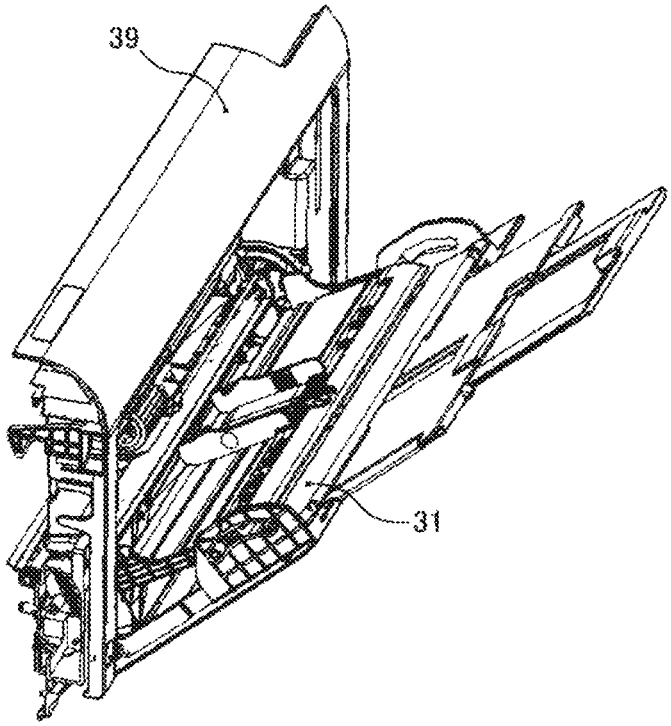

FIGS. 13A and 13B are perspective views each illustrating that the bypass sheet tray 31 is open in a state in which the door 39 is closed to the housing of the image forming apparatus 1000.

As described above, the bypass sheet feeder 30 in the present embodiment has a unit structure in which the relay driven roller 42*b* of the pair of relay rollers 42 is supported integrally with the bypass sheet feeding mechanism. The unit structure including the relay driven roller 42*b* and the bypass sheet feeding mechanism is screwed and fixed to the housing 50 of the image forming apparatus 1000. The door 39 is attached to open and close with respect to the bypass sheet feeding mechanism via a hinge mechanism. The bypass sheet tray 31 is attached to open and close with respect to the door 39 via the hinge mechanism. In the present embodiment, by opening the door 39, the process cartridge containing the photoconductor 1 is attached and detached with respect to the housing 50 of the image forming apparatus 1000 and the recording sheet S that is jammed in the image forming apparatus 1000 is removed from the image forming apparatus 1000.

However, since the relay driven roller 42*b* is supported not by the door 39 but by the bypass sheet feeding mechanism that is screwed and fixed to the housing 50 of the image forming apparatus 1000, the relay driven roller 42*b* and the relay drive roller 42*a* that is provided in the housing 50 of the image forming apparatus 1000 are configured so as not to be separated from each other.

Here, when a device error (problem) to suspend conveyance of the recording sheet S, such as a paper jam error, occurs to the image forming apparatus 1000, the recording sheet S remaining in the image forming apparatus 1000 needs to be removed. Hereinafter, the device error is explained with an example of the device error caused by the paper jam. Specifically, in the present embodiment, the sheet tray 100 is removed from the image forming apparatus 1000 in the sheet conveyance direction or in a direction intersecting the sheet conveyance direction, so that the recording sheet S remaining in the image forming apparatus 1000 is removed (pulled out) from the regular sheet feeder 110. At this time, in order to restrain the recording sheet S, for example, a thin paper and a plain paper each having a relatively low strength, from being torn when the recording sheet S is pulled out, it is preferable to open (separate) the possible areas in which the recording sheet S is held (such as the sheet conveyance nip region of the pair of relay rollers 42 and the nip region of the bypass sheet feed roller 32 and the bypass bottom plate 34).

As the example of a configuration in which the rollers of the pair of relay rollers 42 are separated from each other, known image forming apparatuses employ a configuration in which the relay driven roller 42*b* is supported on the door openably and closably attached to the housing 50 of the image forming apparatus 1000. With this configuration, the pair of relay rollers 42 may be separated by opening the door. However, as described above, since the relay drive roller 42*a* and the relay driven roller 42*b* of the pair of relay rollers 42 are configured so as not to be separated from each other, the pair of relay rollers 42 may not be opened (may not be separated from each other).

Therefore, in the present embodiment, in a case in which a paper jam occurs while the recording sheet S is conveyed in the regular sheet feeder 110, when the recording sheet S that is held by the pair of relay rollers 42 is removed (pulled out), the recording sheet S having a relatively high strength may be torn. In order to restrain this inconvenience, when conveying the recording sheet S having a relatively low strength (e.g., a thin paper and a plain paper), the nip pressure (contact pressure) of the pair of relay rollers 42 is changed to the low nip pressure. Accordingly, even though a paper jam occurs while the recording sheet S such as a thin paper or a plain paper is conveyed, since the nip pressure of the pair of relay rollers 42 is relatively low, the recording sheet S is restrained from being torn when pulling out of the recording sheet S from the pair of relay rollers 42 in the state.

At this time, since the nip pressure of the pair of relay rollers 42 is relatively low, in a case in which the conveyance load of the recording sheet S (e.g., the sliding with the conveyance guide and the conveyance resistance when the leading end of the recording sheet S enters the pair of relay rollers 42) is relatively large, it is likely that the recording sheet S slips at the sheet conveyance nip region of the pair of relay rollers 42, which may cause a conveyance failure in which the recording sheet S is not conveyed properly. However, the recording sheet S such as a thin paper or a plain paper is relatively thin and generally has a low rigidity. Therefore, even when the conveyance load is relatively small and the nip pressure of the pair of relay rollers 42 is relatively low, the conveyance failure is not likely to occur. Therefore, as long as the recording sheet S is a thin paper or a plain paper, even when the nip pressure of the pair of relay rollers 42 is relatively low, the stable sheet conveyance is performed.

On the other hand, when the recording sheet S having a relatively high strength (e.g., thick paper) that is hard to tear is conveyed, the high nip pressure is selected as the nip pressure (contact pressure) of the pair of relay rollers 42. In a case in which the recording sheet S is a thick paper, if the nip pressure of the pair of relay rollers 42 is relatively low, the conveyance failure is likely to occur. However, in the present embodiment, the pair of relay rollers 42 has the high nip pressure when conveying the recording sheet S (thick paper). Therefore, the conveyance failure is hard to occur, thereby achieving the stable sheet conveyance. Further, even if a paper jam occurs, as long as the recording sheet S is a thick paper, even when the nip pressure of the pair of relay rollers 42 is in the high nip pressure state, it is not likely to tear the recording sheet S when the recording sheet S is pulled out from the pair of relay rollers 42.

Note that, if a known configuration is employed to reduce the nip pressure (contact pressure) of the pair of relay rollers 42 after a paper jam has occurred, as long as the operation is performed appropriately after the occurrence of the paper jam, the known configuration may restrain the recording sheet S having a relatively low strength from being torn when the recording sheet S is pulled out. However, depending on the timing of occurrence of the paper jam or the configuration to achieve the paper jam handling, it is not likely to reduce the nip pressure of the pair of relay rollers 42 after the paper jam has occurred. For example, when the above-described jam detection sensor (e.g., the registration sensor 49) is erroneously detected or malfunctions, or the image forming apparatus is immediately disconnected, the drive sources of the main motor 61 and the clutches 62*a*, 63*a*, 64*a*, and 65*a* may not be driven normally, and therefore the nip pressure of the pair of relay rollers 42 may not be lowered when pulling out the jammed recording sheet S.

By contrast, in the present embodiment, in a case in which the recording sheet S is a thin paper or a plain paper, the biasing force of pressure spring 37*b* that biases the relay driven roller 42*b* toward the relay drive roller 42*a* is reduced to lower the nip pressure of the pair of relay rollers 42 before the paper jam occurs, to be more specific, before the recording sheet S is held by the pair of relay rollers 42 (refer to steps S1 to S4 in the flowchart of FIG. 6). Therefore, since there is no need to perform the operation to lower the nip pressure of the pair of relay rollers 42 after occurrence of the paper jam, the recording sheet S such as a thin paper or a plain paper is pulled out while the nip pressure of the pair of relay rollers 42 is relatively low when the paper jam has occurred.

Next, a description is given of change the nip pressure of the pair of relay rollers 42.

In the present embodiment, the nip pressure of the pair of relay rollers 42 is changed in the regular sheet conveyance passage R1 along with movement of a movable member that is used for conveying the recording sheet S in the bypass sheet conveyance passage R2. In the present embodiment, when the recording sheet S is conveyed using the regular sheet conveyance passage R1, the bypass sheet conveyance passage R2 is not used to convey the recording sheet S. Accordingly, when the recording sheet S is conveyed in the regular sheet conveyance passage R1, even if the movable member that is used to convey the recording sheet S in the bypass sheet conveyance passage R2 is moved, no problem occurs.

In the present embodiment, a sheet feeder for bypass sheet feeding such as the bypass sheet feeder 30 causes the recording sheet S on the bypass bottom plate 34 to contact (press against) the bypass sheet feed roller 32, thereby feeding the recording sheet S. Therefore, in the present embodiment, the bypass bottom plate 34 functions as a movable member. Along with movement of the bypass bottom plate 34, the nip pressure of the pair of relay rollers 42 is changed.

Specifically, the moving unit that causes the bypass bottom plate 34 to move rotates the bypass bottom plate cam shaft 65 by the driving force of the main motor 61, as described above. Then, when the bypass bottom plate cam shaft 65 is located at a rotational position at which the bypass bottom plate cam 35 presses down the bottom plate guide 34*a* against the biasing force of the bottom plate spring 36, the bypass bottom plate 34 is lowered (moved downward) to separate from the bypass sheet feed roller 32 (see FIGS. 10 and 15A). On the other hand, when the bypass bottom plate cam shaft 65 is located at the rotational position at which the bypass bottom plate cam 35 separates from the bottom plate guide 34*a*, the bypass bottom plate 34 is lifted (moved upward) by the biasing force of the bottom plate spring 36 to contact the bypass sheet feed roller 32 (see FIGS. 8 and 15B).

The sheet conveying device 200 further includes a pressure plate 37*d* that functions as a biasing force changer according to the present embodiment. The pressure plate 37*d* also functions as a biasing support that supports pressure spring 37*b* that biases the bearing 37*a* of the relay driven roller 42*b* toward the relay drive roller 42*a*. As the pressure plate 37*d* is rotated along with rotation of the bypass bottom plate cam shaft 65, the biasing force of pressure spring 37*b* is changed to change the nip pressure of the pair of relay rollers 42.

Figure 14:
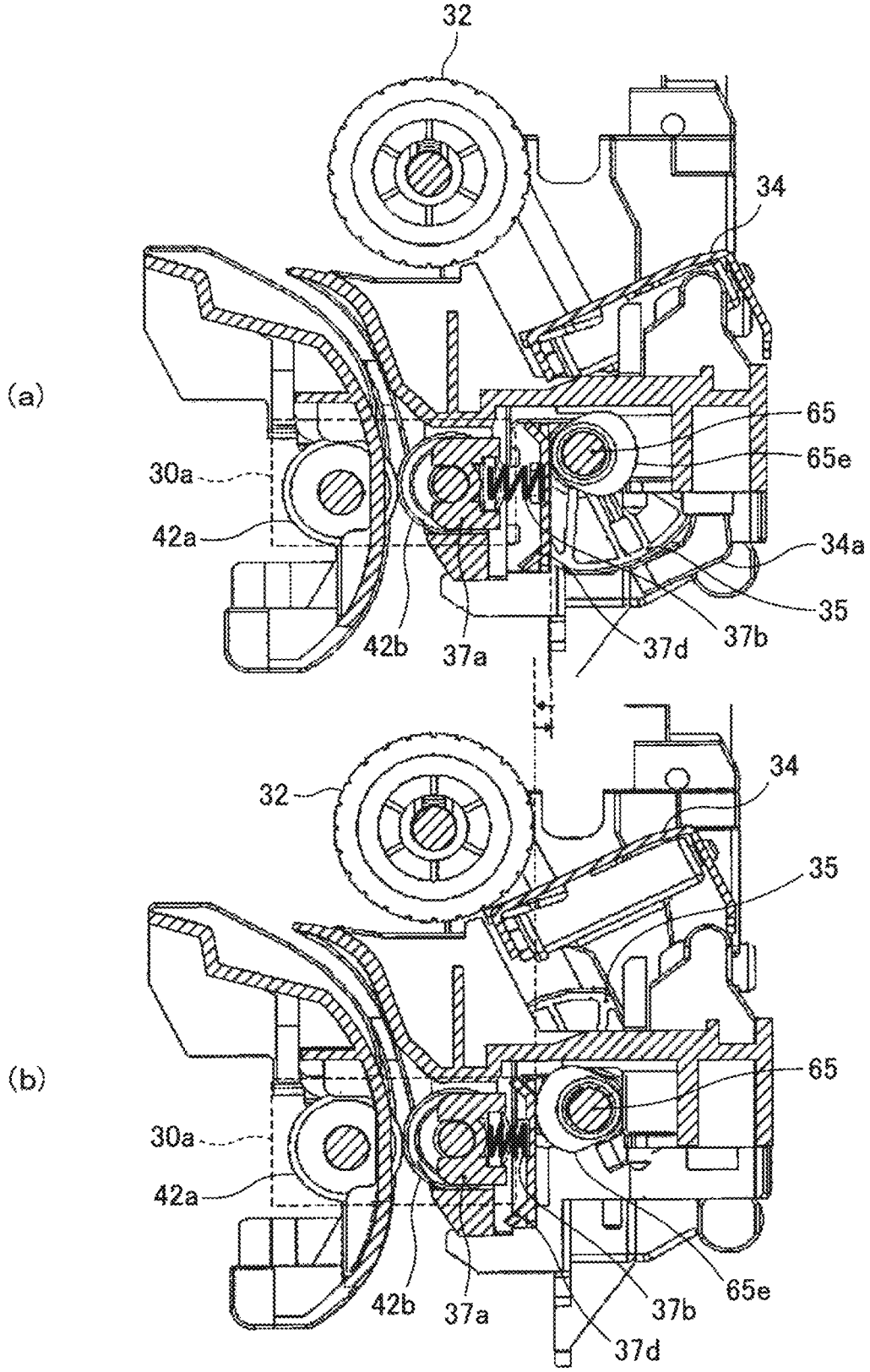
FIG. 14 is a diagram illustrating a biasing force changer that changes the biasing force of a pressure spring that presses a bearing of a relay driven roller toward a relay drive roller.

FIG. 14 is a diagram illustrating, in the present embodiment, the biasing force changer that changes the biasing force of the pressure spring 37*b* that presses the bearing 37*a* of the relay driven roller 42*b* toward the relay drive roller 42*a*.

Figure 15B:
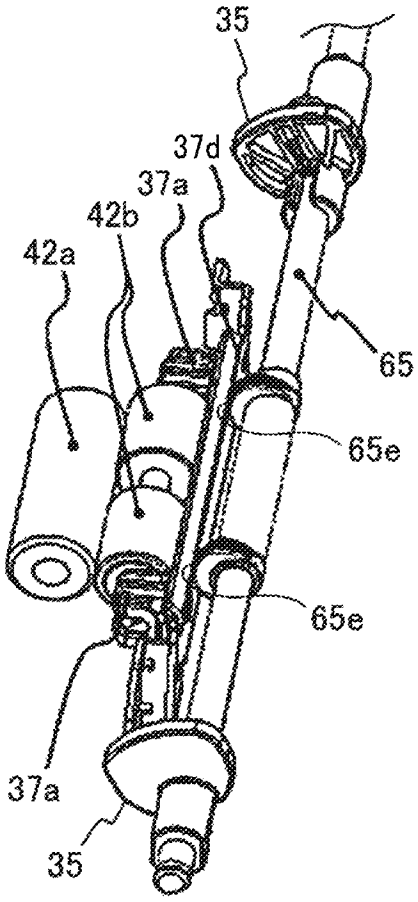
FIGS. 15A and 15B are perspective views each illustrating the main configuration of the biasing force changer.
Figure 15A:
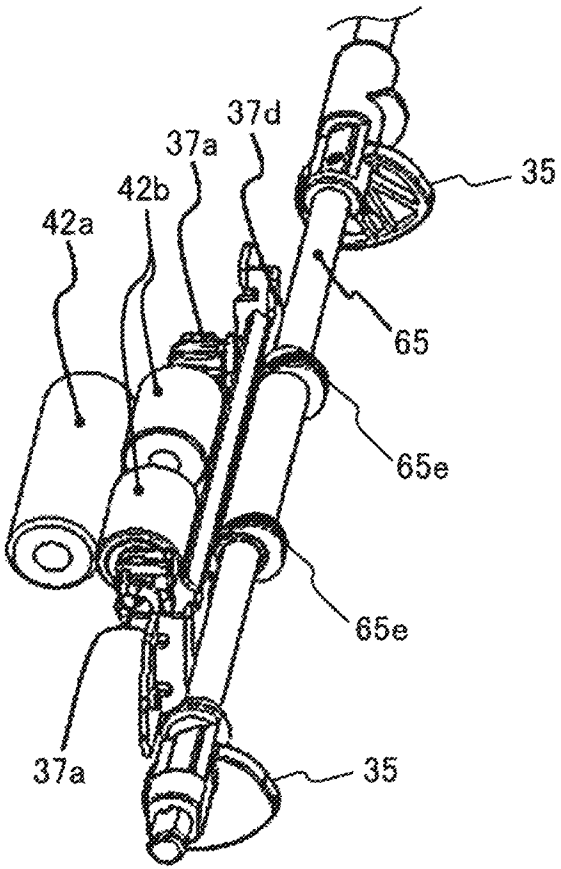

FIGS. 15A and 15B are perspective views each illustrating the main configuration of the biasing force changer.

Figure 16A:
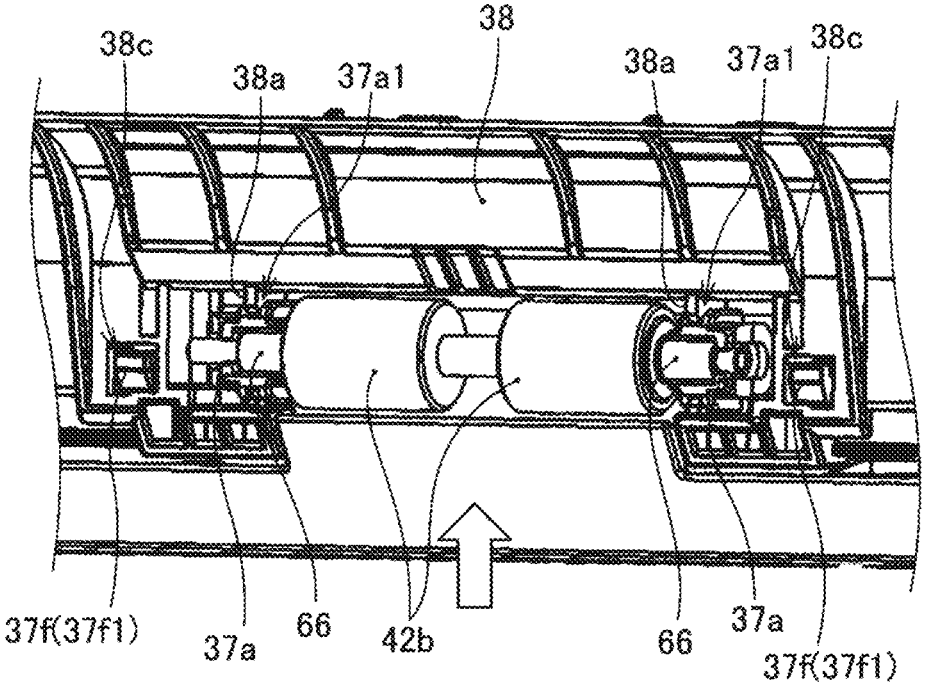
FIG. 16A is a perspective view illustrating the biasing force changer in which a pressing portion on a bypass bottom plate cam shaft is located at a pressing position and the nip pressure of a pair of relay rollers increases.
Figure 16B:
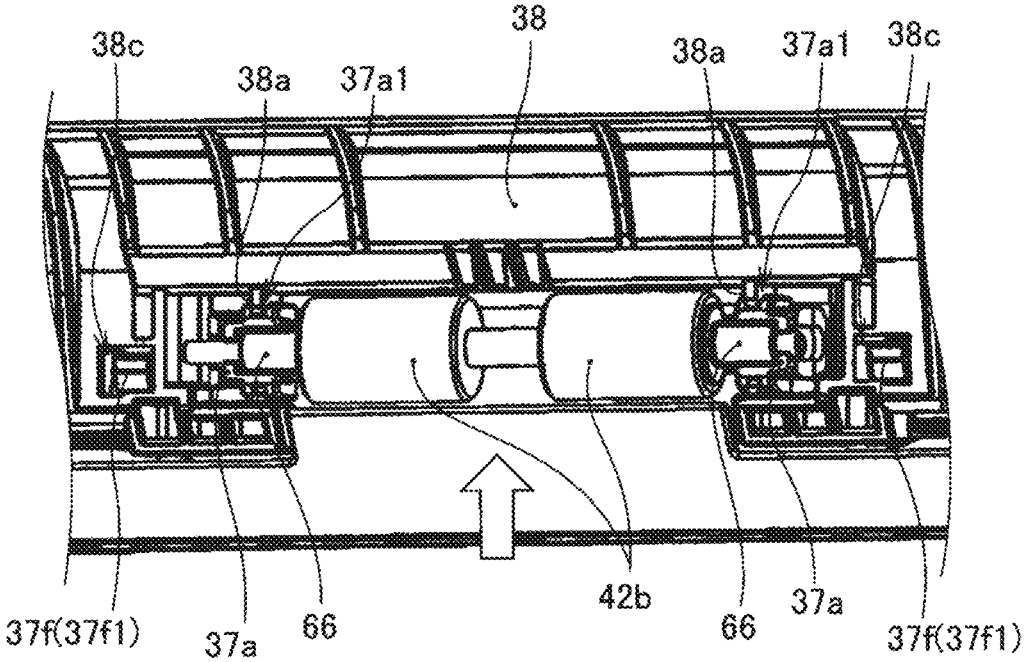
FIG. 16B is a perspective view illustrating the biasing force changer in which the pressing portion is located at a non-pressing position and the nip pressure of the pair of relay rollers decreases.

FIG. 16A is a perspective view illustrating the biasing force changer in which a pressing portion 65*e* mounted on the bypass bottom plate cam shaft 65 is located at a pressing position and the nip pressure of the pair of relay rollers 42 increases. FIG. 16B is a perspective view illustrating the biasing force changer in which the pressing portion 65*e* is located at a non-pressing position and the nip pressure of the pair of relay rollers 42 decreases.

As illustrated in FIGS. 16A and 16B, a guide groove 37*a*1 that is provided on the bearing 37*a* of the relay driven roller 42*b* is fitted to a projection 38*a* that is provided on the support frame 38 of the bypass sheet feeder 30. By so doing, the roller shaft 66 of the relay driven roller 42*b* is held so that the relay driven roller 42*b* slides in a direction to separate from the relay drive roller 42*a*. Further, as described above, the bearing 37*a* of the relay driven roller 42*b* is biased by the pressure spring 37*b*, toward the relay drive roller 42*a*.

Figure 17:
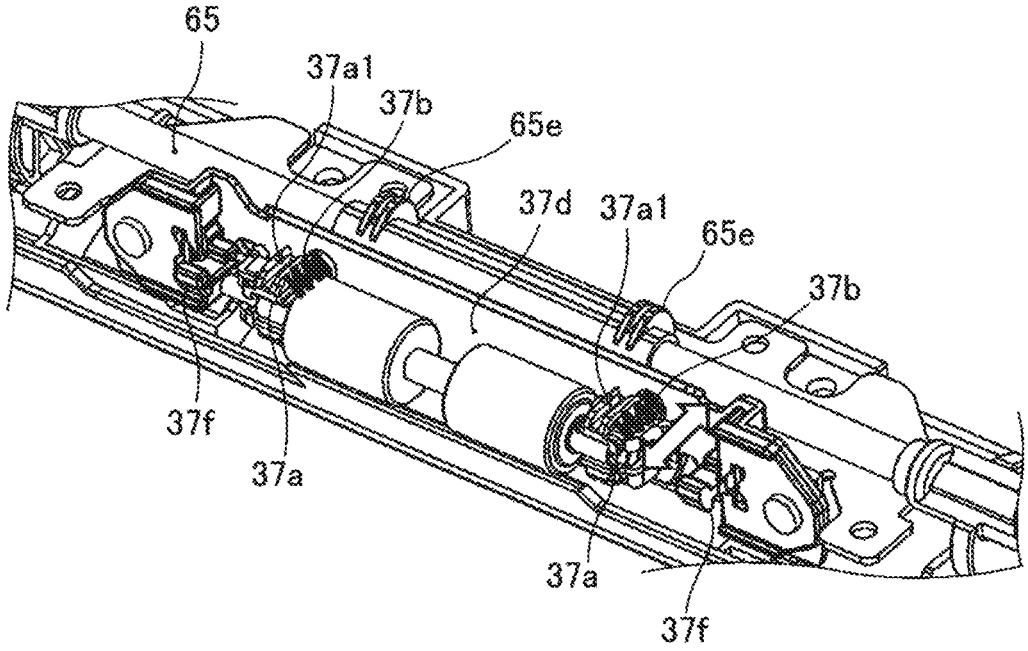
FIG. 17 is a perspective view illustrating the biasing force changer that changes the biasing force of the pressure spring.

FIG. 17 is a perspective view illustrating the biasing force changer that changes the biasing force of the pressure spring.

The pressure spring 37*b* is a compression spring disposed so that one end of the pressure spring 37*b* contacts the bearing 37*a* of the relay driven roller 42*b* and the opposite end of the pressure spring 37*b* contacts the pressure plate 37*d*. The bearing 37*a* of the relay driven roller 42*b* is biased toward the relay drive roller 42*a* by the biasing force of the pressure spring 37*b* that is supported by the pressure plate 37*d*, The pressing portion 65*e* that is capable of pressing the pressure plate 37*d* toward the relay drive roller 42*a* is formed on the back face of the pressure plate 37*d*, which is opposite a spring contact face to which the pressure spring 37*b* contacts. The pressing portion 65*e* rotates along with rotation of the bypass bottom plate cam shaft 65.

When the rotational position of the bypass bottom plate cam shaft 65 is located at a position to lower the bypass bottom plate 34 (that is, a position at which the bypass bottom plate 34 separates from the bypass sheet feed roller 32), the pressing portion 65*e* on the bypass bottom plate cam shaft 65 is located at a non-pressing position, as illustrated in part (a) of FIG. 14 and FIG. 15A. At this time, the pressure plate 37*d* moves in the direction to separate from the relay drive roller 42*a* by the biasing force of the pressure spring 37*b*. Therefore, the pressure spring 37*b* expands to decrease the amount of contraction, thereby reducing the biasing force of the pressure spring 37*b*. As a result, the biasing force to bias the relay driven roller 42*b* toward the relay drive roller 42*a* is reduced, the nip pressure of the pair of relay rollers 42 is lowered. Note that, since the bypass bottom plate 34 remains separated from the bypass sheet feed roller 32, the recording sheet P is not fed from the bypass sheet feeder 30. However, conveyance of the recording sheet S in the regular sheet feeder 110 does not hinder conveyance of the recording sheet S from the bypass sheet feeder 30.

By contrast, when the rotational position of the bypass bottom plate cam shaft 65 is located at a position to lift the bypass bottom plate 34 (that is, a position at which the bypass bottom plate 34 contacts the bypass sheet feed roller 32), the pressing portion 65*e* on the bypass bottom plate cam shaft 65 is located at a pressing position, as illustrated in part (b) of FIG. 14 and FIG. 15B. At this time, the pressure plate 37*d* moves in the direction to approach the relay drive roller 42*a* against the biasing force of the pressure spring 37*b*. Therefore, the pressure spring 37*b* contracts to increase the amount of contraction, thereby increasing the biasing force of the pressure spring 37*b*. As a result, the biasing force to bias the relay driven roller 42*b* toward the relay drive roller 42*a* increases, the nip pressure of the pair of relay rollers 42 increases. Note that, since the bypass bottom plate 34 remains in contact with the bypass sheet feed roller 32, the recording sheet P is not fed from the bypass sheet feeder 30. However, conveyance of the recording sheet S in the regular sheet feeder 110 does not hinder conveyance of the recording sheet S from the bypass sheet feeder 30.

According to the present embodiment, the nip pressure of the pair of relay rollers 42 (the biasing force of pressure spring 37*b*) is changed in the regular sheet conveyance passage R1 along with movement of the bypass bottom plate 34 that functions as a movable member used for conveying the recording sheet S in the bypass sheet conveyance passage R2. Accordingly, a simple configuration that does not include a dedicated operation unit that changes the nip pressure of the pair of relay rollers 42 achieves the change in the nip pressure of the pair of relay rollers 42.

Figure 18:
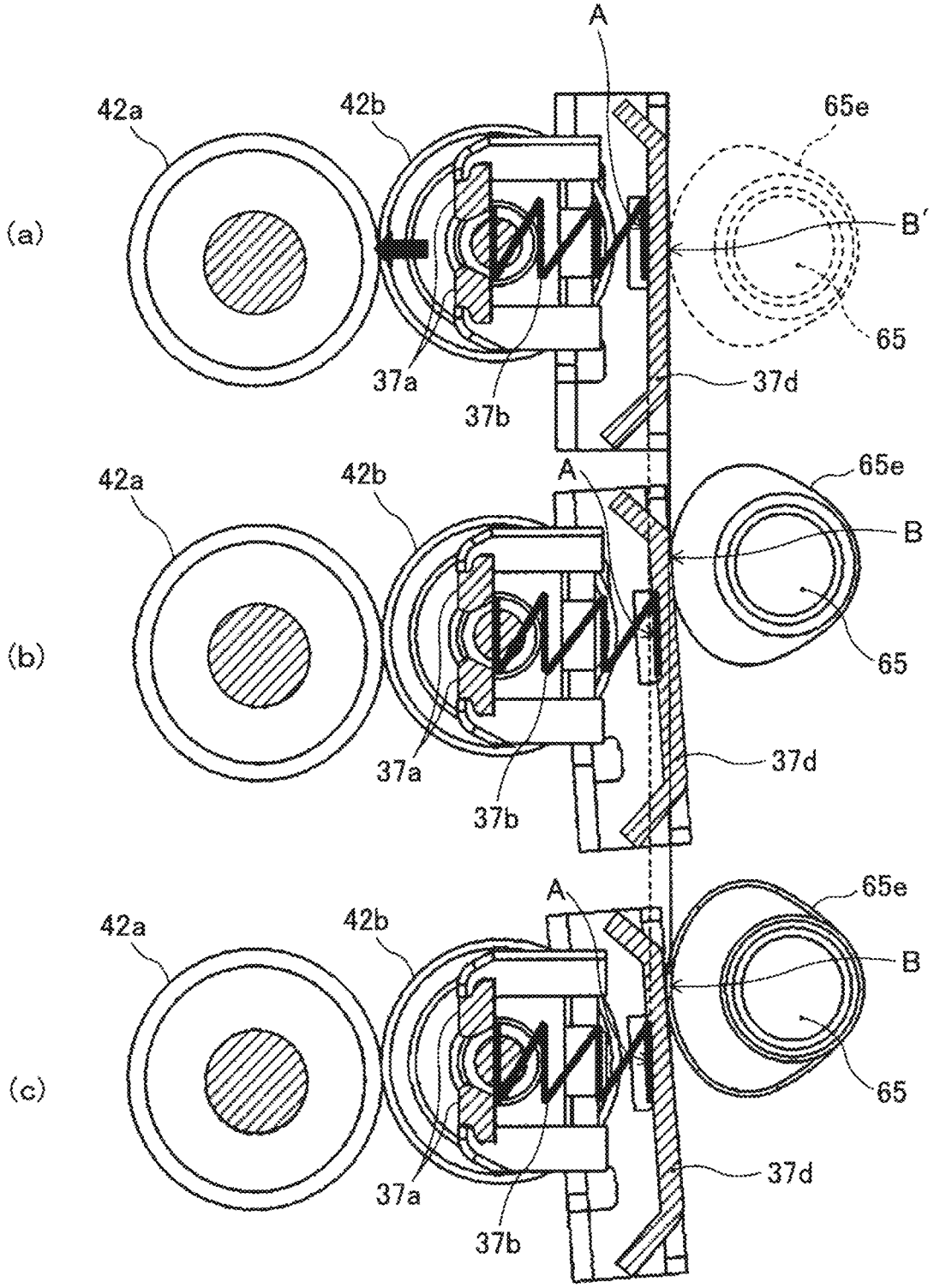
FIG. 18 is a diagram illustrating a portion at which the pressing portion presses the pressure plate.

FIG. 18 is a diagram illustrating a portion at which the pressing portion 65*e* mounted on the bypass bottom plate cam shaft 65 presses the pressure plate 37*d*.

As illustrated in part (a) of FIG. 18, the pressing portion 65*e* on the bypass bottom plate cam shaft 65 may press the pressure plate 37*d* along the biasing direction of the pressure spring 37*b* at the position B' that is the same position as the support position A of the pressure spring 37*b* on the pressure plate 37*d*. In this case, since the pressing amount of the pressure plate 37*d* by the pressing portion 65*e* is substantially the same as the amount of contraction of the pressure spring 37*b* the biasing force is set easily.

However, in the present embodiment, since the arrangement as illustrated in part (a) of FIG. 18 is difficult to achieve due to the restrictions of the device layout, the pressure plate 37*d* is pressed along the biasing direction of the pressure spring 37*b* at the position B that is shifted from the support position A of the pressure spring 37*b* on the pressure plate 37*d*. In this case, the rotational moment around the support position A of the pressure spring 37*b* is generated to the pressure plate 37*d*. Therefore, as illustrated in part (b) of FIG. 18, the pressure plate 37*d* is tilted, and the amount of contraction of the pressure spring 37*b* becomes smaller than the pressing amount of the pressure plate 37*d* by the pressing portion 65*e*. Therefore, the actual biasing force becomes below the desired biasing force.

Therefore, in the present embodiment, as illustrated in part (c) of FIG. 18, the pressing amount of the pressure plate 37*d* by the pressing portion 65*e* is set to be greater than the target amount of contraction of the pressure spring 37*b*. Accordingly, even in a case in which the pressure plate 37*d* is pressed at the position B that is shifted from the support position A of the pressure spring 37*b* on the pressure plate 37*d*, the pressure spring 37*b* is contracted to the target amount of contraction, and a desired biasing force is obtained.

However, if the pressure plate 37*d* is pressed by the pressing portion 65*e* at the position B that is shifted from the support position. A of the pressure spring 37*b*, the pressing portion 65*e* slides with the pressure plate 37*d* along with rotation of the pressing portion 65*e*. Due to the sliding of the pressing portion 65*e* with the pressure plate 37*d*, the position of the pressure plate 37*d* is likely to change. Therefore, each time the pressing portion 65*e* moves to the pressing position or the non-pressing position, it is likely that the position of the pressure plate 37*d* (in particular, the angle of rotation about the support position A of the pressure spring 37*b*) changes. When the position of the pressure plate 37*d* changes, even if the pressing portion 65*e* moves to the pressing position or the non-pressing position, the amount of contraction of the pressure spring 37*b* changes, the biasing force fluctuates, and the nip pressure of the pair of relay rollers 42 is not stabilized.

In order to address this inconvenience, in the present embodiment, a guide unit is provided to guide the pressure plate 37*d* so that the pressure plate 37*d* moves straight forward along the biasing direction of the pressure spring 37*b* while the pressure plate 37*d* remains at the constant position (without rotating about the support position A of the pressure spring 37*b*).

Figure 19A:
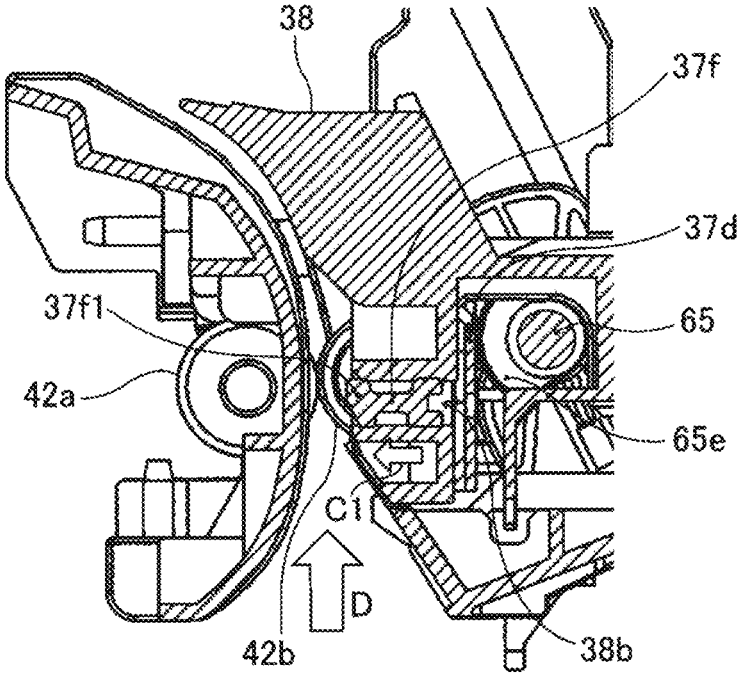
FIG. 19A is a cross sectional view illustrating the biasing force changer in a state in which the pressing portion is located at the pressing position and the nip pressure of the pair of relay rollers increases.

FIG. 19A is a cross sectional view illustrating the biasing force changer in a state in which the pressing portion 65*e* is located at the pressing position and the nip pressure of the pair of relay rollers 42 increases.

Figure 19B:
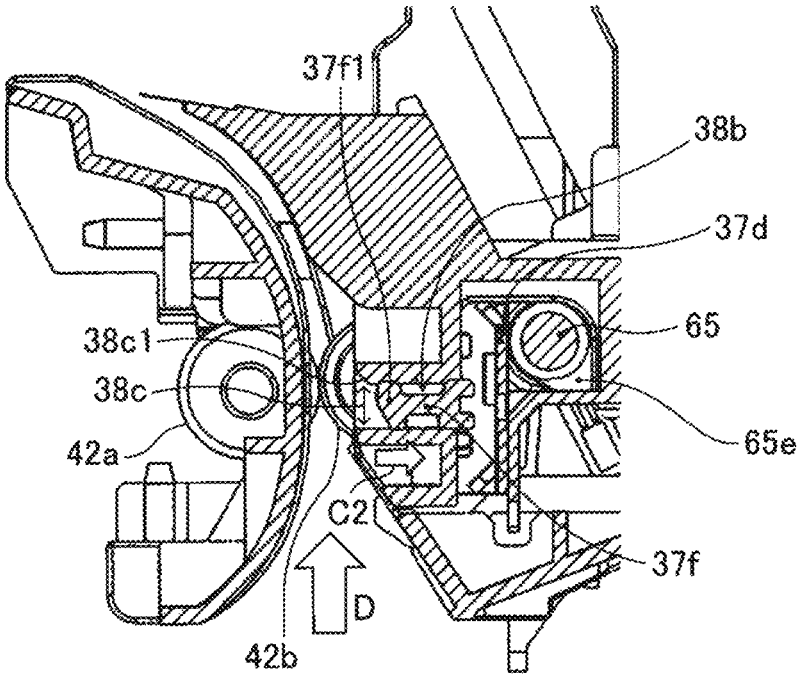
FIG. 19B is a cross sectional view the biasing force changer in which the pressing portion is located at the non-pressing position and the nip pressure of the pair of relay rollers decreases.

FIG. 19B is a cross sectional view the biasing force changer in which the pressing portion 65*e* is located at the non-pressing position and the nip pressure of the pair of relay rollers 42 decreases.

The guide unit according to the present embodiment includes a slider 37*f* and a slide groove 38*b*. The slider 37*f* functions as a guide target member provided on both sides of the pressure plate 37*d* in the axial direction of the relay driven roller 42*b* (see FIG. 17). The slide groove 38*b* functions as a guide member to guide the slider 37*f* so that the slider 37*f* moves along the biasing direction of the pressure spring 37*b*.

The slide groove 38*b* is provided on the support frame 38 of the bypass sheet feeder 30 to guide the slider 37*f* of the pressure plate 37*d* by holding from the vertical direction (direction substantially orthogonal to the biasing direction of the pressure spring 37*b* and to the axial direction of the relay driven roller 42*b*). By so doing, when changing the biasing force of the pressure spring 37*b*, as the pressure plate 37*d* moves by the pressing force of the pressing portion 65*e* and the biasing force of the pressure spring 37*b*, the slider 37*f* of the pressure plate 37*d* is guided by the slide groove 38*b* of the support frame 38, and the pressure plate 37*d* moves straight forward along the biasing direction of the pressure plate 37*d*.

With this guide unit, even if the moment of rotation about the support position A of the pressure spring 37*b* (about the shaft that is substantially parallel to the axial direction of the relay driven roller 42*b* and that passes the support position A) occurs on the pressure plate 37*d*, the slider 37*f* contacts the slide groove 38*b* to restrict the rotation of the pressure plate 37*d*. To be more specific, the upper face portion (or the lower face portion) of the slider 37*f* on the upstream side in the moving direction of the slider 37*f* contacts the upper face (or lower face) of the inner wall of the slide groove 38*b*. Further, the lower face portion (or the upper face portion) of the slider 37*f* on the downstream side in the moving direction of the slider 37*f* contacts the lower face (or upper face) of the inner wall of the slide groove 38*b*. By so doing, the rotation of the pressure plate 37*d* is restricted.

By the slider 37*f* contacting the slide groove 38*b* as described above, the position of the pressure plate 37*d* on which the moment of rotation is generated becomes stable with the rotation being restricted. In this state, the pressure plate 37*d* moves straight forward. Accordingly, each time the pressing portion 65*e* moves to the pressing position or the non-pressing position, the change in the position of the pressure plate 37*d* is restrained, and therefore the fluctuation of the nip pressure of the pair of relay rollers 42 is restrained.

However, there is a clearance (vertical clearance) between the slider 37*f* of the pressure plate 37*d* and the slide groove 38*b* of the support frame 38 so that the slider 37*f* slides on the slide groove 38*b*. Therefore, the pressure plate 37*d* on which the moment of rotation is generated moves straight forward along the biasing direction while the slider 37*f* slides on the slide groove 38*b* in the state in which the slider 37*f* has rotated by the amount of the clearance with the slide groove 38*b*. In a case in which the slider 37*f* moves straight in this state, the position of the pressure plate 37*d* (in particular, the angle of rotation about the support position A of the pressure spring 37*b*) may change depending on the contact state of the slider 37*f* on the slide groove 38*b*. Therefore, in a case in which the change of the position of the pressure plate 37*d* is too large, the fluctuation of the nip pressure of the pair of relay rollers 42 exceeds the acceptable error range, and therefore the nip pressure of the pair of relay rollers 42 is not stabilized.

As a method of reducing the change in the position of the pressure plate 37*d* as much as possible, it is effective to elongate the length of the slider 37*f* and the length of the slide groove 38*b* (the length of the pressure plate 37*d* in the straight moving direction). In this case, when the same vertical clearance is provided to the slider 37*f* and the slide groove 38*b*, as the length of the slider 37*f* and the length of the slide groove 38*b* increase, the angle of rotation of the pressure plate 37*d* due to the moment of rotation is restrained to be smaller. This is achieved because, as the length of the slider 37*f* and the length of the slide groove 38*b* increase, when the rotation of the pressure plate 37*d* is restricted, the distance increases between the position at which the upper face portion (or the lower face portion) of the slider 37*f* on the upstream side in the moving direction of the slider 37*f* contacts the upper face (or lower face) of the inner wall of the slide groove 38*b* and the position at which the lower face portion (or the upper face portion) of the slider 37*f* on the downstream side in the moving direction of the slider 37*f* contacts the lower face (or upper face) of the inner wall of the slide groove 38*b*.

However, there is a limit to increasing the length of the slider 37*f* and the length of the slide groove 38*b* due to restrictions on the device layout. In particular, since various components are disposed on the side in the direction in which the relay driven roller 42*b* separates from the relay drive roller 42*a*, as indicated by arrow C2 illustrated in FIG. 19B, it is often difficult to physically increase the length of the slider 37*f* and the length of the slide groove 38*b* to the side in the direction C2. On the other hand, there is a space to function as the sheet conveyance passage on the side in the direction in which the relay driven roller 42*b* approaches the relay drive roller 42*a*, as indicated by arrow C1 illustrated in FIG. 19A. Therefore, the length of the slider 37*f* and the length of the slide groove 38*b* may increase in the direction C1 without physical restrictions.

Therefore, in the present embodiment, in order to increase the length of the slider 37*f* and the length of the slide groove 38*b* as long as possible, the tip portion 37*f*1 of the slider 37*f* (the end on the side in the direction in which the relay driven roller 42*b* approaches the relay drive roller 42*a*) projects into the sheet conveyance passage, closer to the side where the relay driven roller 42*b* contacts the relay drive roller 42*a*, than to the side of the end of the slide groove 38*b* of the support frame 38. With this configuration, the length of the slider 37*f* and the length of the slide groove 38*b* are longer when compared with the configuration in which the tip portion 37*f*1 of the slider 37*f* do not project into the sheet conveyance passage. Accordingly, the change in the position of the pressure plate 37*d* is reduced as much as possible, and the nip pressure of the pair of relay rollers 42 is stabilized.

Further, in a case in which the tip portion 37*f*1 of the slider 37*f* projects into the sheet conveyance passage, the leading end of the sheet contacts the tip portion 37*f*1 of the slider 37*f* while the sheet is being conveyed. At this time, if the leading end of the sheet that is being conveyed is caught by the tip portion 37*f*1 of the slider 37*f*, a paper jam is likely to occur.

Therefore, the tip portion 37*f*1 of the slider 37*f* according to the present embodiment includes a guide to guide the leading end of the recording sheet downstream in a sheet conveyance direction D even if the leading end of the recording sheet contacts while the recording sheet is conveyed. The guide may be any guide member as long as the leading end of the recording sheet is not caught by the tip portion 37*f*1 of the slider 37*f*.

In the present embodiment, the guide is achieved by providing the guiding shape to the tip portion 37*f*1 of the slider 37*f* to slide the leading end of the sheet that contacts the tip portion 37*f*1 of the slider 37*f*, downstream in the sheet conveyance direction D. Specifically, the tip portion 37*f*1 projecting into the sheet conveyance passage has an upstream face that is provided on the upstream side of the tip portion 37*f*1 of the slider 37*f* in the sheet conveyance direction D. The upstream face has a tapered shape (guiding shape). With this guiding shape, even if the leading end of the recording sheet S that is being conveyed contacts the tip portion 37*f*1 of the slider 37*f*, the leading end of the recording sheet S is guided downstream in the sheet conveyance direction D. and therefore the recording sheet S is restrained from being caught by the tip portion 37*f*1 of the slider 37*f*.

Further, in the present embodiment, when the pressing portion 65*e* is located at the non-pressing position, the tip portion 37*f*1 of the slider 37*f* is at the position at which the tip portion 37*f*1 of the slider 37*f* do not project into the sheet conveyance passage, as illustrated in FIG. 19B. In this case, since the leading end of the recording sheet S that is being conveyed does not contact the tip portion 37*f*1 of the slider 37*f* the recording sheet S is prevented from being caught by the tip portion 37*f*1 of the slider 37*f*. However, the support frame 38 that defines the sheet conveyance passage has a portion that acts as a slot 38*c* through which the tip portion 37*f*1 of the slider 37*f* comes in and out (moves). Therefore, it is likely that the leading end of the recording sheet S that is being conveyed is caught by a downstream edge 38*c*1 of the slot 38*c* in the sheet conveyance direction D.

In order to address this inconvenience, in the present embodiment, as illustrated in FIG. 19B, the downstream edge 38*c*1 of the slot 38*c* in the sheet conveyance direction D has a chamfered shape that functions as a guiding shape to guide the leading end of the recording sheet downstream in the sheet conveyance direction D even when the leading end of the recording sheet S contacts the downstream edge 38*c*1 of the slot 38*c* while the recording sheet S is being conveyed. With this guiding shape, when the tip portion 37*f*1 of the slider 37*f* is at the position at which the tip portion 37*f*1 of the slider 37*f* does not project into the sheet conveyance passage, even if the leading end of the recording sheet S that is being conveyed contacts the downstream edge 38*c*1 of the slot 38*c* in the sheet conveyance direction D, the leading end of the recording sheet S is guided downstream in the sheet conveyance direction D, and therefore the recording sheet S is restrained from being caught by the tip portion 37*f*1 of the slider 37*f*.

Figure 20:
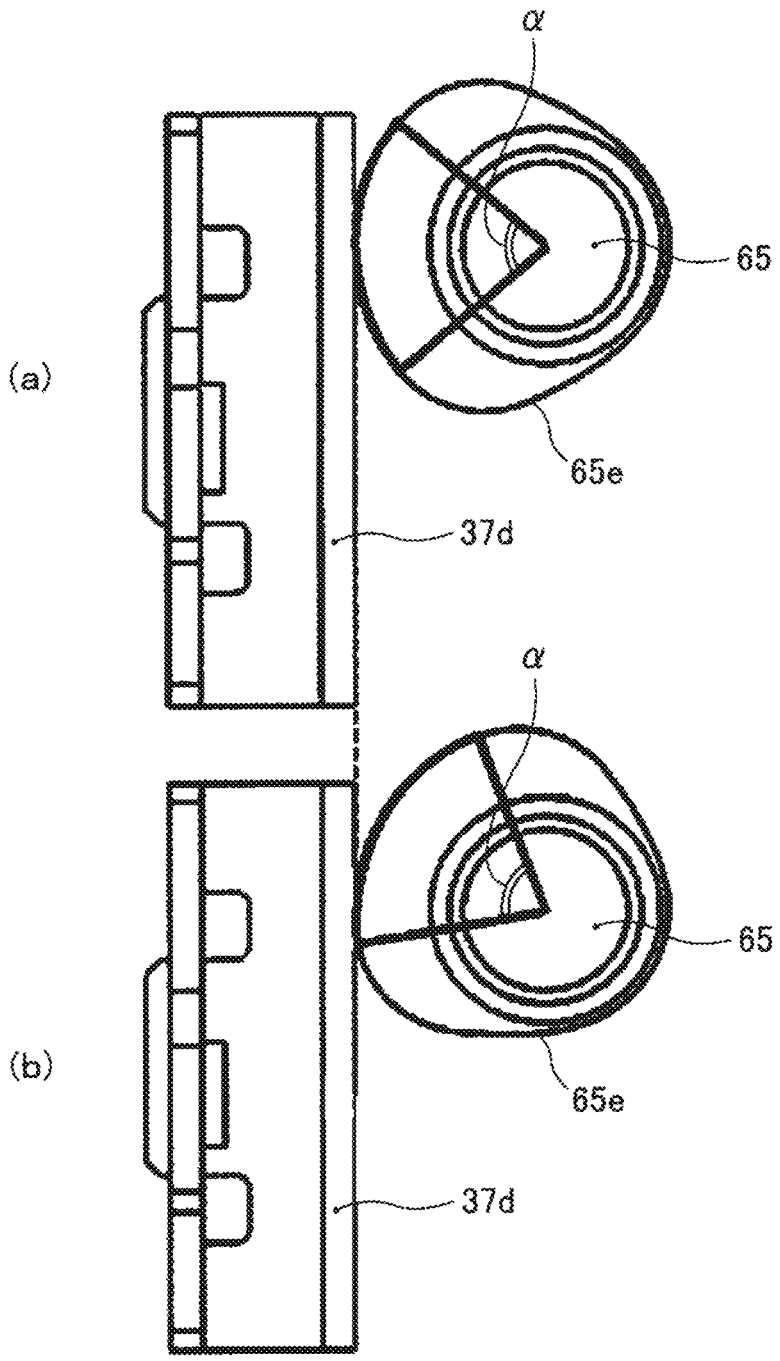
FIG. 20 is a diagram illustrating the shape of the pressing portion on the bypass bottom plate cam shaft.

FIG. 20 is a diagram illustrating the shape of the pressing portion 65*e* on the bypass bottom plate cam shaft 65

In the present embodiment, the pressing portion 65*e* is a cam. In the present embodiment, even if the rotation position (phase) of the pressing portion 65*e* of the bypass bottom plate cam shaft 65 is shifted due to the tolerance of parts or the error of the stop time in control, the pressing portion 65*e* is configured to have a constant cam outer diameter within the predetermined angle width a including the target rotation angle of the pressing position. According to this configuration, for example, the pressing amount of the pressure plate 37*d* by the pressing portion 65*e* when the pressing portion 65*e* has stopped at the rotational position illustrated in part (a) of FIG. 20 is same as the pressing amount of the pressure plate 37*d* by the pressing portion 65*e* when the pressing portion 65*e* has stopped at the rotational position illustrated in part (h) of FIG. 20. As a result, the biasing force reaches the target biasing force (nip pressure of the pair of relay rollers 42) even when the rotational position of the pressing portion 65*e* at the pressing position is shifted due to the tolerance of the parts or the error of the stop time in control.

Figure 21:
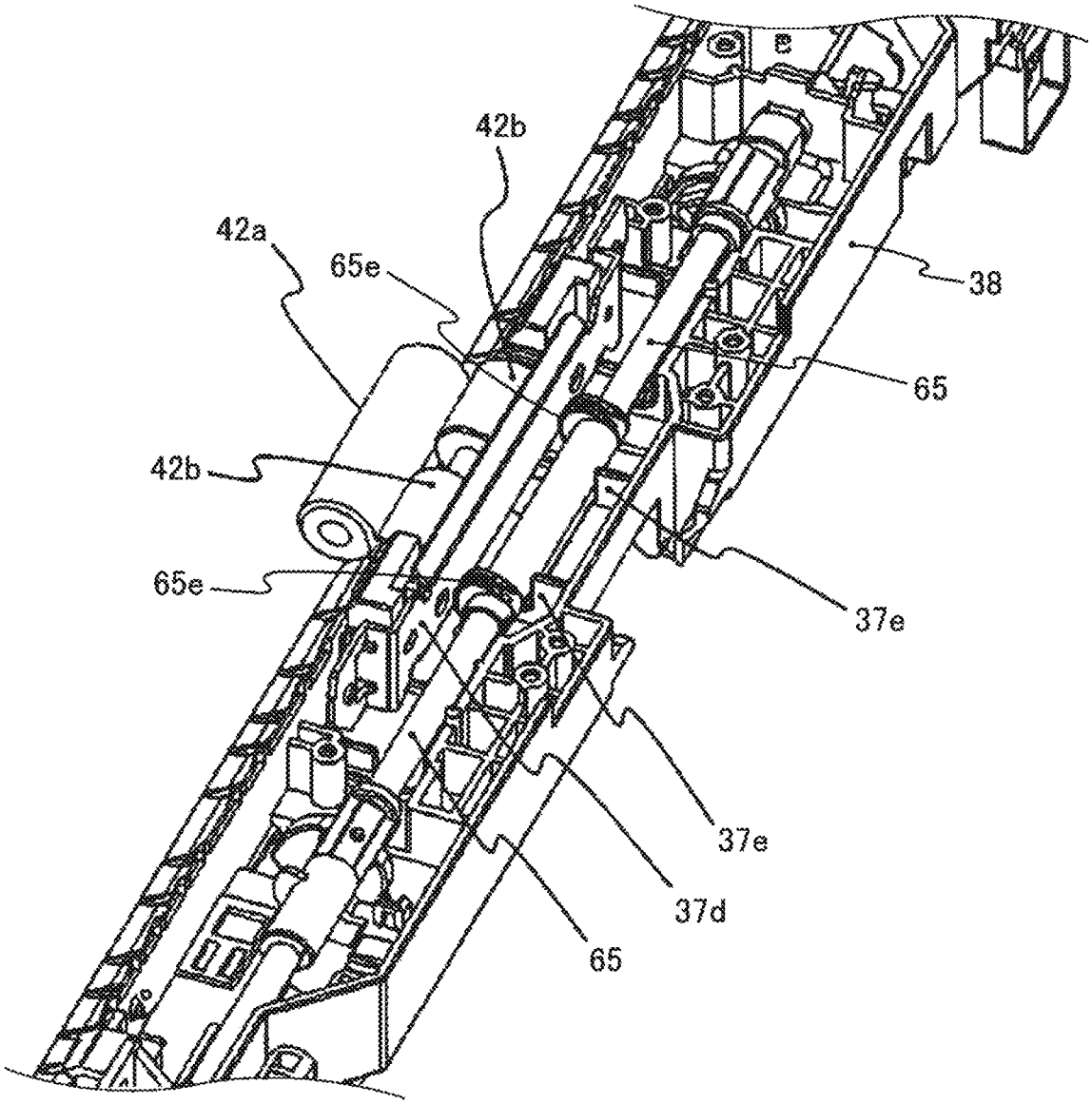
FIG. 21 is a diagram illustrating a warp restrainer that restrains the warp of the bypass bottom plate cam shaft including the pressing portion that presses the pressure plate.

FIG. 21 is a diagram illustrating a warp restrainer that restrains the warp of the bypass bottom plate cam shaft 65 including the pressing portion 65*e* that presses the pressure plate 37*d*.

Since the reaction force of the biasing force of the pressure spring 37*b* that biases the relay driven roller 42*b* toward the relay drive roller 42*a* acts on the pressure plate 37*d*, the reaction force is transmitted to the bypass bottom plate cam shaft 65 via the pressing portion 65*e* that contacts the pressure plate 37*d*. Consequently, if the bypass bottom plate cam shaft 65 is warped, the pressing amount of the pressure plate 37*d* by the pressing portion 65*e* decreases, and therefore the biasing force may not reach the target biasing force (the nip pressure of the pair of relay rollers 42).

Therefore, in the present embodiment, a contact portion 37*e* is provided as a warp restrainer that restrains the warp of the bypass bottom plate cam shaft 65. The contact portion 37*e* contacts the bypass bottom plate cam shaft 65 to restrain the warp of the bypass bottom plate cam shaft 65. The contact portion 37*e* is a part of the support frame 38 of the bypass sheet feeder 30. Although there are two contact portions 37*e* in the present embodiment, one or three or more contact portions 37*e* may be provided.

Next, a description is given of a process flow of operations for an irregular stop (e.g., paper jam) in the image forming apparatus 1000.

Figure 22:
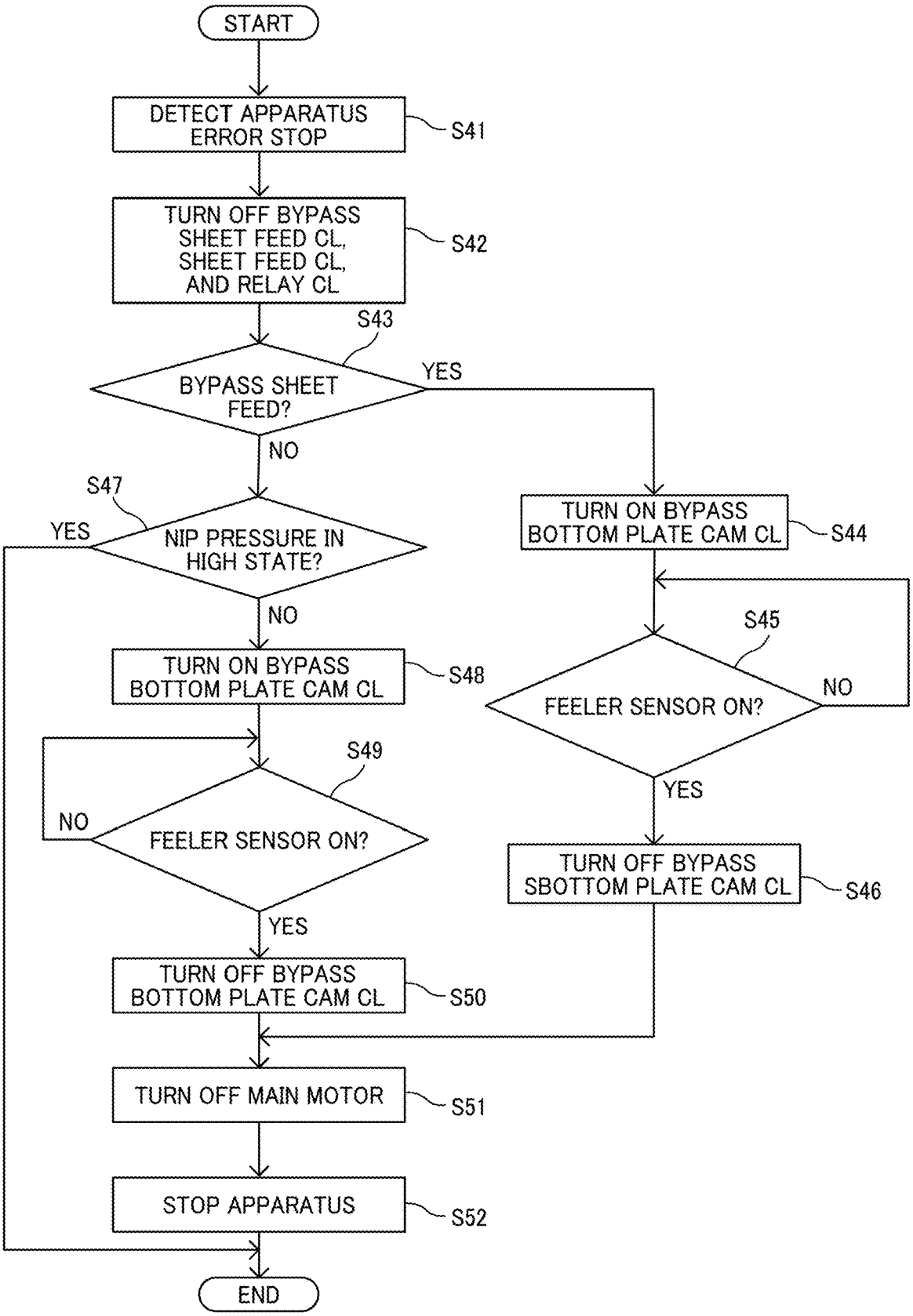
FIG. 22 is a flowchart of a process flow of operations for an irregular stop of the image forming apparatus according to an embodiment of this disclosure.

FIG. 22 is a flowchart of a process flow of operations for an irregular stop of the image forming apparatus 1000 according to an embodiment of this disclosure.

In the image forming apparatus 1000, when a device error (problem) to suspend conveyance of the recording sheet S, such as a conveyance failure (including a paper jam), is detected (step S41), the controller 51 first turns off the regular sheet feed clutch 62*a*, relay clutch 63*a*, and the bypass sheet feed clutch 64*a* (step S42). Then, the controller 51 determines, from control data, whether the recording sheet S is being conveyed by the bypass sheet feeder 30 (step S43).

When the recording sheet S is being conveyed by the bypass sheet feeder 30 (YES in step S43), in the present embodiment, the recording sheet S is being held (gripped) between the bypass sheet feed roller 32 and the bypass bottom plate 34, in other words, the bypass bottom plate 34 is in contact with the bypass sheet feed roller 32 (FIGS. 8 and 14B). Therefore, the bypass sheet feed roller 32 and the bypass bottom plate 34 are separated from each other.

That is, the state in which the bypass bottom plate 34 is in contact with the bypass sheet feed roller 32 indicates the state in which the feeler sensor 65*c* is turned off, the controller 51 first turns on the bypass sheet bottom plate cam clutch 65*a* (step S44) to rotate the bypass bottom plate cam shaft 65. Then, the controller 51 determines whether the feeler sensor 65*c* is turned on (step S45). When the feeler sensor 65*c* is not turned on (NO in step S45), the controller 51 causes the process to continue step S45 until the feeler sensor 65*c* is turned on. When the feeler sensor 65*c* is turned on (YES in step 45), the controller 51 turns off the bypass sheet bottom plate cam clutch 65*a* (step S46) to stop rotation of the bypass bottom plate cam shaft 65. Thereafter, the controller 51 turns off the main motor 61 (step S51), and then stops the image forming apparatus 1000 (step S52), so that the user can remove the jammed recording sheet(s) S from in the image forming apparatus 1000.

With the above-described control, when a device error (problem) to suspend conveyance of the recording sheet S occurs when conveying the recording sheet S by the bypass sheet feeder 30, the bypass bottom plate 34 is separated from the bypass sheet feed roller 32. This control facilitates removal of the recording sheet S remaining in the bypass sheet conveyance passage R2 (in other words, the recording sheet S sandwiched between the bypass sheet feed roller 32 and the bypass bottom plate 34).

Further, when the recording sheet S is being conveyed by the regular sheet feeder 110 (not by the bypass sheet feeder 30) (NO in step S43), it is likely that the recording sheet S is being sandwiched (held) between the rollers of the pair of relay rollers 42. At this time, when it is determined that the type of the recording sheet S is a thick paper and the sheet is being conveyed, the nip pressure of the pair of relay rollers 42 is in the high nip pressure state.

Here, in a case in which the recording sheet S that is actually conveyed is a thick paper (sheet having high strength), as described above, even if the nip pressure of the pair of relay rollers 42 is in the high nip pressure state, the recording sheet S is pulled out and removed without tearing the recording sheet S without being torn. However, due to a manual operation error or a setting error, in a case in which the recording sheet S that is actually conveyed is a thin paper or a plain paper (sheet having low strength), the recording sheet S is torn when being pulled out from the image forming apparatus 1000 when the nip pressure of the pair of relay rollers 42 is relatively high. Therefore, it is desirable to lower the nip pressure of the pair of relay rollers 42. Further, even when the recording sheet actually conveyed is a thick paper (having a relatively high strength), a relatively large force is used to pull out the recording sheet S when the pair of relay rollers 42 is in the high nip pressure state. Therefore, it is desirable to lower the nip pressure of the pair of relay rollers 42 to enhance the workability of paper jam handling.

Therefore, in the present embodiment, when the recording sheet S is being conveyed in the regular sheet feeder 110 (NO in step S43), the controller 51 determines whether the recording sheet S is a thin paper or a plain paper (step S47). When the recording sheet S is a thin paper of a plain paper (YES in step S47), the operation in the flowchart of FIG. 22 is finished. When the recording sheet S is a thick paper and the recording sheet S is being conveyed (NO in step S47), that is, when the bypass bottom plate 34 contacts the bypass sheet feed roller 32 (the feeler sensor 65*c* is turned off) and the pair of relay rollers 42 is in the high nip pressure state, the controller 51 causes the bypass sheet bottom plate cam clutch 65*a* to turn on (step S48) to rotate the bypass bottom plate cam shaft 65. Then, the feeler sensor 65*c* is turned on, that is, the bypass bottom plate 34 is lowered to the lowest position. By so doing, the bypass bottom plate cam shall 65 rotates continuously until the nip pressure of the pair of relay rollers 42 is lowered. Then, the controller 51 determines whether the feeler sensor 65*c* is turned on (step S49). When the feeler sensor 65*c* is turned on (YES in step S49), the controller 51 causes the bypass sheet bottom plate cam clutch 65*a* to turn off (step S50) to stop rotation of the bypass bottom plate cam shall 65. Thereafter, the controller 51 turns off the main motor 61 (step S51), and then stops the image forming apparatus 1000 (step S52), so that the user can remove the jammed recording sheet(s) S from in the image forming apparatus 1000.

Accordingly, since the nip pressure of the pair of relay rollers 42 is changed from the high nip pressure state to the low nip pressure state, even when the recording sheet S that is actually conveyed is a thin paper or a plain paper (having a relatively low strength), the recording sheet S is pulled out without tearing the recording sheet S. Further, when the recording sheet S actually conveyed is a thick paper (having a relatively high strength), the recording sheet S is easily pulled out without using a relatively large power, and therefore the workability of paper jam handling is enhanced.

As described above, in the configuration of the present embodiment, the nip pressure of the pair of relay rollers 42 (e.g., the biasing force of pressure spring 37*b*) that is used for conveying the recording sheet S in the regular sheet conveyance passage R1 is changed along with movement of the bypass bottom plate 34 functioning as a movable member that is used for conveying the recording sheet S in the bypass sheet conveyance passage R2. However, a configuration of the sheet conveying device is not limited to this configuration. For example, in a case in which the bypass sheet feeder 30 employs a sheet feeder having a configuration in which the bypass sheet feed roller 32 is lowered (moved downward) to press (contact) the bypass sheet feed roller 32 to a recording sheet on the bypass sheet tray 31 to feed the recording sheet, the bypass sheet feed roller 32 may be a movable member to change the nip pressure of the pair of relay rollers 42 along with movement of the bypass sheet feed roller 32. Further, for example, the rollers of the pair of relay rollers 42 may be changed along with movement of a movable member that is used in a sheet conveyance passage other than the bypass sheet conveyance passage R2 (for example, the reverse sheet conveyance passage R5).

Further, in the present embodiment, a description of the changing unit to change the nip pressure of the pair of relay rollers 42 (the biasing force of pressure spring 37*b*) used in the regular sheet conveyance passage R1 has been made but any other changing unit may be applied. For example, a changing unit to change the nip pressure of another pair of conveyance rollers (for example, the pair of sheet ejection rollers 46) may be employed. In addition, the pair of relay rollers 42 of the present embodiment is a target object to change the nip pressure is a pair of sheet conveying rollers including a drive roller and a driven roller. However, the configuration of the pair of sheet conveying rollers applied to the present embodiment is not limited to the above-described pair of relay rollers 42. For example, the pair of sheet conveying rollers may include two drive rollers or two driven rollers.

Further, the pair of relay rollers 42 according to the present embodiment includes the rollers that are not separated from each other. However, the rollers of the pair of relay rollers 42 may be separated from each other.

Further, in the present embodiment according to this disclosure, the image forming apparatus 1000 is described as an example of a printer. However, the image forming apparatus 1000 may be a copier including an image reading device or a copier having a function of a facsimile machine. Further, this disclosure is applicable to image forming apparatuses adapted to form images through other schemes, such as known ink jet schemes, known toner projection schemes, or the like as well as to image forming apparatuses adapted to form images through electrophotographic schemes. Further, as long as a sheet conveying device is provided, this disclosure is not limited to an image forming apparatus but is also applicable to an image reading device provided with an automatic document feeder (ADF).

The configurations according to the above-descried embodiments are not limited thereto. This disclosure can achieve the following aspects effectively.

Aspect 1.

In Aspect 1, a sheet conveying device (for example, the sheet conveying device 200) includes a pair of rollers (for example, the pair of relay rollers 42), a biasing member (for example, the pressure spring 37*b*), a guide member (for example, the slide groove 38*b*), a biasing support (for example, the pressure plate 37*d*), and a biasing force changer (for example, the pressure plate 37*d* and the pressing portion 65*e*). The pair of rollers includes a first roller (for example, the relay driven roller 42*b*) and a second roller (for example, the relay drive roller 42*a*) disposed in contact with the first roller. The pair of rollers is configured to hold a sheet (for example, the recording sheet S) between the first roller and the second roller while the sheet is conveyed. The biasing member is configured to bias the first roller toward the second roller. The biasing support is configured to support the biasing member. The biasing support has a guide target member (for example, the slider 370 configured to slide along the guide to move the biasing support. The biasing force changer is configured to change a biasing force of the biasing member along with movement of the biasing support. The guide target member has a portion (for example, the tip portion 37*f*1) projecting toward inside a sheet conveyance passage through which the sheet is conveyed by the pair of rollers.

There is a clearance between the guide target member and the guide member so that the guide target member and the guide member are relatively movable to each other. Therefore, in a case in which the moment of rotation about the shaft extending in the direction orthogonal to the moving direction of the biasing support occurs to the biasing support, the biasing support rotates by the amount of the clearance between the guide target member and the guide member to change the position of the biasing support.

In order to restrain the change in the position of the biasing support, it is effective to increase the length of the guide target member and the length of the guide member (the length in the moving direction of the biasing support). This configuration is effective because, as the length of the guide target member and the length of the guide member increase, when the rotation of the biasing support is restricted, the distance increases between the contact position of the guide target member and the guide member contacting each other on the upstream side in the moving direction of the biasing support and the contact position of the guide target member and the guide member contacting each other on the downstream side in the moving direction of the biasing support, thereby reducing the angle of rotation of the biasing support due to the moment of rotation.

According to the configuration of Aspect 1, the length of the guide target member is elongated until the part of the guide target member projects toward inside the sheet conveyance passage. Therefore, when compared with a known configuration in which the guide target member does not project toward inside the sheet conveyance passage, the length of the guide target member and the length of the guide member (the length in the moving direction of the biasing support) increase. Accordingly, the change in the position of the biasing support is reduced as much as possible, and the nip pressure of the pair of rollers is stabilized.

Aspect 2.

In Aspect 2 according to Aspect 1, the portion (for example, the tip portion 37*f*1) of the guide target member (for example, the slider 37*f*) is a guide portion configured to guide a leading end of the sheet (for example, the recording sheet S) downstream in a sheet conveyance direction even when the leading end of the sheet contacts the portion of the guide target member.

According to the configuration of Aspect 2, even if the leading end of the sheet that is being conveyed contacts the portion of the guide target member that projects toward inside the sheet conveyance passage, the leading end of the sheet is guided downstream in the sheet conveyance direction, and therefore the sheet is restrained from being caught by the part of the guide target member.

Aspect 3.

In Aspect 3 according to Aspect 2, the guide portion has a guiding shape to slide the leading end of the sheet (for example, the recording sheet S) that has contact the portion (for example, the tip portion 37*f*1) of the guide target member (for example, the slider 370 downstream in the sheet conveyance direction.

According to the configuration of Aspect 3, with a simple configuration, the sheet is restrained from being caught by a part of the guide target member that projects toward inside the sheet conveyance passage.

Aspect 4.

In Aspect 4 according to any one of Aspects 1 to 3, wherein the biasing force changer (for example, the pressure plate 37*d* and the pressing portion 65*e*) is configured to cause the biasing support (for example, the pressure plate 37*d*) to move between a projection position at which the portion of the guide target member (for example, the slider 370 is projected toward inside the sheet conveyance passage and a non-projection position at which the portion of the guide target member is not projected toward inside the sheet conveyance passage.

According to the configuration of Aspect 4, a long moving distance of the biasing support is achieved.

Aspect 5.

In Aspect 5 according to Aspect 4, the sheet conveying device (for example, the sheet conveying device 200) further includes an opening (for example, the slot 38*c*) through which the portion (for example, the tip portion 37*f*1) of the guide target member (for example, the slider 370 moves, the opening having a plurality of edges. Of the plurality of edges of the opening, at least a downstream edge (for example, the downstream edge 38*c*1) of the opening in the sheet conveyance direction has a guiding shape (for example, the chamfered shape) configured to guide the leading end of the sheet (for example, the recording sheet S) downstream in the sheet conveyance direction even when the leading end of the sheet contacts the downstream edge of the opening.

According to the configuration of Aspect 5, when the guide target member is not projected toward inside the sheet conveyance passage, even if the leading end of the sheet that is being conveyed contacts the edge of the opening, the leading end of the sheet is guided downstream in the sheet conveyance direction, and therefore the sheet is restrained from being caught by the edge of the opening.

In Aspect 6 according to any one of Aspects 1 to 5, the guide target member (for example, the slider 370 is an elongated member (the slider 37*f*) configured to extend in a straight direction along which the biasing support (for example, the pressure plate 37*d*) moves straight in a biasing direction of the biasing member (for example, the pressure spring 37*b*). A tip portion (for example, the tip portion 37*f*1) of the guide target member (for example, the slider 37*f*) is configured to project toward inside the sheet conveyance passage.

According to the configuration of Aspect 6, a simple member such as a spring is employed to bias as a biasing member.

Aspect 7.

In Aspect 7, the image forming apparatus (for example, the image forming apparatus 1000) further includes a pressing portion (for example, the pressing portion 65*e*) mounted on a rotary shall (for example, the bypass bottom plate cam shaft 65). The biasing force changer is configured to move the biasing support along with rotation of the rotary shaft as the pressing portion presses the biasing support at a position (for example, the position B) shifted from a support position (for example, the support position A) of the biasing member in the biasing support.

According to the configuration of Aspect 7, the biasing force changer moves the biasing support even if the pressing portion mounted on the rotary shaft does not press the biasing support at the same position (for example, the position B') that is the same position as the support position of the biasing member at the biasing support. At this time, even if a rotational moment around the support position A of the biasing member is generated in the biasing support, the length of the guide target member (for example, the slider 370 and the length of the guide (for example, the slide groove 38*b*), in other words, the length in the moving direction of the biasing support, are long. Therefore, the change in position of the biasing support is relatively small, and the nip pressure of the pair of rollers is stabilized.

Aspect 8.

In Aspect 8, an image forming apparatus (for example, the image forming apparatus 1000) includes the sheet conveying device (for example, the sheet conveying device 200) according to any one of Aspects 1 to 7, and an image bearer (for example, the photoconductor 1) configured to form an image on the sheet (for example, the recording sheet P) conveyed by the sheet conveying device.

According to the configuration of Aspect 8, an image forming apparatus having the stable nip pressure of a pair of rollers that conveys a sheet is provided.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a pair of rollers including a first roller and a second roller disposed in contact with the first roller, the pair of rollers being configured to hold a sheet between the first roller and the second roller while the sheet is conveyed;

a spring configured to bias the first roller toward the second roller;

a guide member;

a biasing support configured to support the spring, the biasing support having a guide target member configured to slide along the guide member; and a pressure system configured to change a biasing force of the spring along with movement of the biasing support, wherein the guide target member has a portion projecting into a sheet conveyance passage through which the sheet is conveyed by the pair of rollers.

2. The sheet conveying device according to claim 1, wherein the portion of the guide target member is a guide portion configured to guide a leading end of the sheet downstream in a sheet conveyance direction even when the leading end of the sheet contacts the portion of the guide target member.

3. The sheet conveying device according to claim 2, wherein the guide portion has a guiding shape to slide the leading end of the sheet that has contact the portion of the guide target member downstream in the sheet conveyance direction.

4. The sheet conveying device according to claim 1, wherein the pressure system is configured to cause the biasing support to move between a projection position at which the portion of the guide target member is projected in the sheet conveyance passage and a non-projection position at which the portion of the guide target member is not projected in the sheet conveyance passage.

5. The sheet conveying device according to claim 4, further comprising:

an opening through which the portion of the guide target member moves, the opening having a plurality of edges, wherein, of the plurality of edges of the opening, at least a downstream edge of the opening in a sheet conveyance direction has a guiding shape configured to guide a leading end of the sheet downstream in the sheet conveyance direction even when the leading end of the sheet contacts the downstream edge of the opening.

6. The sheet conveying device according to claim 1, wherein the guide target member is an elongated member configured to extend in a straight direction along which the biasing support moves straight in a biasing direction of the spring, and wherein a tip portion of the guide target member is configured to project into the sheet conveyance passage.

7. The sheet conveying device according to claim 6, further comprising:

a pressing portion mounted on a rotary shaft, wherein the pressure system is configured to move the biasing support along with rotation of the rotary shaft as the pressing portion presses the biasing support at a position shifted from a support position of the spring in the biasing support.

8. An image forming apparatus comprising:

the sheet conveying device according to claim 1; and an image bearer configured to form an image on the sheet conveyed by the sheet conveying device.

9. The sheet conveying device according to claim 1, wherein the guide member includes a groove.

10. The sheet conveying device according to claim 6, further comprising:

a support frame defining the sheet conveyance passage and defining the opening.

* * * * *